US011883710B2

(12) United States Patent
Hamady

(10) Patent No.: US 11,883,710 B2
(45) **Date of Patent: *Jan. 30, 2024**

(54) HAND WEIGHT

(71) Applicant: Peter Winston Hamady, Silver Spring, MD (US)

(72) Inventor: Peter Winston Hamady, Silver Spring, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/112,058

(22) Filed: Feb. 21, 2023

(65) Prior Publication Data

US 2023/0241443 A1 Aug. 3, 2023

Related U.S. Application Data

(63) Continuation of application No. 17/868,101, filed on Jul. 19, 2022, now Pat. No. 11,607,575.
(Continued)

(51) Int. Cl.
*A63B 21/072* (2006.01)
*A63B 21/00* (2006.01)
*A63B 21/06* (2006.01)

(52) U.S. Cl.
CPC ..... *A63B 21/072* (2013.01); *A63B 21/0602* (2013.01); *A63B 21/4035* (2015.10); *A63B 2214/00* (2020.08)

(58) Field of Classification Search
CPC ..... A63B 21/0004; A63B 21/00189; A63B 21/008; A63B 21/0084; A63B 21/0602; A63B 21/0603; A63B 21/0618; A63B 21/072; A63B 21/4035; A63B 21/4045; A63B 2209/00; A63B 2214/00;
(Continued)

(56) References Cited

U.S. PATENT DOCUMENTS 1,918,142 A * 7/1933 Smith ..... A63B 21/0726 D21/681
2,819,081 A * 1/1958 Touraine ..... A63B 21/0618 482/45

(Continued)

FOREIGN PATENT DOCUMENTS

CH 710075 3/2016
DE 202015001445 U1 * 4/2015 ..... A63B 21/0608

(Continued)

OTHER PUBLICATIONS

International Search Report and Written Opinion in International Appln. No. PCT/US2023/010405, dated May 10, 2023, 16 pages.

*Primary Examiner* — Gary D Urbiel Goldner
(74) *Attorney, Agent, or Firm* — Fish & Richardson P.C.

(57) ABSTRACT

A hand weight includes a chassis including a handle portion configured to be grasped by a user such that a forearm of the user extends along an axis, and a flexible element attached to the chassis. The hand weight can be configured to receive a movable mass, and the flexible element can be configured to at least partially support the movable mass such that the movable mass forms at least part of a sprung mass of a hand weight assembly including the hand weight and the movable mass, the sprung mass configured to move relative to the chassis of the hand weight and deform the flexible element in response to a force in a direction along the axis applied to the handle portion by the user while grasping the handle portion.

20 Claims, 25 Drawing Sheets

Related U.S. Application Data

(60) Provisional application No. 63/305,994, filed on Feb. 2, 2022.

(58) Field of Classification Search
CPC ..... A63B 2244/10; A63B 2244/102; A63B 2244/104; A63B 2244/106
See application file for complete search history.

(56) References Cited

U.S. PATENT DOCUMENTS 3,756,592 A * 9/1973 Johnson ..... A63B 21/0608 482/110
3,843,117 A * 10/1974 Johnson ..... A63B 21/0603 482/110
4,575,074 A * 3/1986 Damratoski ..... A63B 21/072 482/93
4,632,391 A * 12/1986 Orak ..... A63B 21/0608 482/44
4,695,051 A 9/1987 Jenison
4,770,409 A * 9/1988 Wallisch ..... A63B 21/4035 482/45
4,773,640 A * 9/1988 Kolbel ..... A63B 21/0602 482/108
4,854,575 A * 8/1989 Wilson ..... A63B 21/0602 482/108
4,896,880 A * 1/1990 Caruthers ..... A63B 21/0722 482/108
5,246,413 A * 9/1993 Koblick ..... A63B 21/0004 482/121
5,674,162 A * 10/1997 Ellingson ..... A63B 21/0004 482/44
5,692,944 A * 12/1997 Pellicone ..... A63B 21/0004 273/109
6,224,517 B1 * 5/2001 Dereszynski ..... A63B 21/0602 482/93
6,312,364 B1 * 11/2001 Selsam ..... A63B 21/072 482/52
6,500,102 B1 * 12/2002 Domenge ..... A63B 15/005 482/148
6,629,911 B2 * 10/2003 Cook ..... A63B 21/065 482/124
6,652,420 B2 * 11/2003 Chen ..... A63B 21/4035 482/45
7,238,147 B2 * 7/2007 Mills ..... A63B 23/12 482/106
7,241,251 B2 * 7/2007 Patterson ..... A63B 21/0728 482/44
7,563,210 B2 * 7/2009 Smith ..... A63B 21/0004 482/110
7,708,671 B2 * 5/2010 Burkhardt ..... A63B 21/026 482/106
7,785,240 B2 * 8/2010 Stugart ..... A63B 21/0601 482/50
7,841,972 B1 * 11/2010 Huang ..... A63B 21/027 601/72
7,857,737 B1 * 12/2010 Ware ..... A63B 15/005 482/40
7,878,952 B2 * 2/2011 Fenelon ..... A63B 21/075 482/93
7,927,264 B2 * 4/2011 Verheem ..... A63B 15/005 482/110
8,118,717 B1 * 2/2012 Lai ..... A63B 21/0608 482/108
8,133,160 B2 * 3/2012 Verheem ..... A63B 15/005 482/121
8,485,949 B2 * 7/2013 Hsu ..... A63B 21/027 482/121
8,814,765 B2 * 8/2014 Bernstein ..... A63B 21/4035 482/110
8,911,334 B1 * 12/2014 Cotter ..... A63B 21/4005 482/111
8,974,351 B2 * 3/2015 Wallisch ..... A63B 21/4035 482/44
9,259,607 B2 * 2/2016 Kokenis ..... A63B 21/0608
9,468,836 B2 * 10/2016 Huang ..... A63B 21/4007
9,861,851 B1 * 1/2018 Owens ..... A63B 21/4017
10,369,401 B2 * 8/2019 Brown, Jr. ..... A63B 21/0724
10,569,120 B2 * 2/2020 Sorin ..... A63B 21/4035
10,737,133 B2 * 8/2020 Bezemer ..... A63B 23/03508
11,040,241 B1 * 6/2021 Fiocchi ..... A63B 21/22
11,517,783 B2 * 12/2022 Hamady ..... A63B 21/22
11,607,575 B1 * 3/2023 Hamady ..... A63B 21/0602
2002/0077225 A1 * 6/2002 Selsam ..... A63B 21/072 482/93
2005/0096200 A1 * 5/2005 Amann ..... A63B 21/0602 482/110
2008/0146418 A1 * 6/2008 Summers ..... A63B 21/0023 482/91
2009/0075792 A1 * 3/2009 Stugart ..... A63B 21/06 482/93
2011/0224054 A1 * 9/2011 Bernstein ..... A63B 23/12 482/110
2011/0287909 A1 * 11/2011 Morris ..... A63B 23/12 482/122
2013/0137556 A1 * 5/2013 Farber ..... A63B 21/4033 482/110
2013/0184123 A1 * 7/2013 McLoughney ..... A63B 21/22 482/8
2013/0260969 A1 * 10/2013 Huang ..... A63B 21/00069 482/122
2013/0267390 A1 * 10/2013 Warren ..... A63B 21/075 482/93
2013/0274076 A1 10/2013 Smith
2013/0316886 A1 * 11/2013 Lynch ..... A63B 21/4035 482/146
2017/0001060 A1 * 1/2017 D'Alesio ..... A63B 21/0602 482/91
2017/0120104 A1 * 5/2017 Douglass ..... A63B 23/14
2021/0353993 A1 * 11/2021 Hamady ..... A63B 21/0608

FOREIGN PATENT DOCUMENTS

EP 1280584 2/2003
JP 2012040358 A * 3/2012 ..... A63B 21/0608
JP 2013500083 1/2013
KR 20110049990 A * 5/2011 ..... A63B 21/0608
WO WO 2011011778 1/2011

* cited by examiner

HAND WEIGHT

CLAIM OF PRIORITY

This application is a continuation application of U.S. patent application Ser. No. 17/868,101, filed on Jul. 19, 2022, which claims priority U.S. Provisional Patent Application Ser. No. 63/305,994, filed on Feb. 2, 2022, the entire contents of which are hereby incorporated by reference.

TECHNICAL FIELD

This specification relates to a hand weight.

BACKGROUND

Hand weights are used for various training exercises. A dumbbell is a conventional hand weight that includes two fixed masses on both ends of a handle of the dumbbell. When a user grasps the handle of the dumbbell and moves the dumbbell in a motion to perform an exercise, the fixed masses travel with the handle.

SUMMARY

The present disclosure describes a hand weight that includes a movable mass (e.g., a flowable mass) that moves relative to the rest of the hand weight during use by a user. The movable mass can deform a flexible element of the hand weight during this movement. This hand weight design can smooth out peak forces experienced by a user, thereby reducing a risk of injury and improving overall comfort for the user when performing an exercise with the hand weight.

In one aspect, a hand weight includes a chassis including a handle portion configured to be grasped by a user such that a forearm of the user extends along an axis, a flexible membrane positioned around the chassis, the flexible membrane being attached to the chassis, and a cavity positioned around the chassis and being at least partially defined by the flexible membrane and the chassis. The cavity can be configured to receive a movable mass that can be movable within the cavity, the movable mass configured to move relative to the chassis and cause deformation of the flexible membrane in response to a force in a direction along the axis of the forearm applied to the handle portion by the user while grasping the handle portion.

In another aspect, a hand weight includes a chassis including a handle portion configured to be grasped by a user such that a forearm of the user extends along an axis, and a flexible element attached to the chassis. The hand weight can be configured to receive a movable mass, and the flexible element can be configured to at least partially support the movable mass such that the movable mass forms at least part of a sprung mass of a hand weight assembly including the hand weight and the movable mass, the sprung mass configured to move relative to the chassis of the hand weight and deform the flexible element in response to a force in a direction along the axis applied to the handle portion by the user while grasping the handle portion.

In another aspect, a hand weight includes a toroidal structure defining an opening extending through a center of the toroidal structure and including a flexible membrane at least partially defining a cavity within an outer surface of the toroidal structure, and a handle portion extending from a first portion of the toroidal structure, through the opening, to a second portion of the toroidal structure, the handle portion configured to be grasped by a user. The cavity can be configured to receive a movable mass that can be movable within the cavity, the movable mass configured to move relative to the toroidal structure and cause deformation of the flexible membrane in response to a force or a torque applied to the handle portion by the user while grasping the handle portion.

In another aspect, a method of using a hand weight grasped by a hand of a user includes accelerating the hand weight along an axis in a forward direction. Accelerating the hand weight in the forward direction includes causing a center of gravity of the hand weight to shift along the axis in a rearward direction relative to the hand of the user. The method includes accelerating the hand weight along the axis in a rearward direction. Accelerating the hand weight in the rearward direction includes causing the center of gravity of the hand weight to shift along the axis in the forward direction relative to the hand of the user.

In another aspect, a method of using a hand weight grasped by a hand of a user is featured. The method includes applying a force in a forward direction along an axis on the hand weight. Applying the force in the forward direction includes causing a center of gravity of the hand weight to shift along the axis in a rearward direction relative to the hand of the user. The method includes applying a torque in a first direction about the axis on the hand weight. Applying the torque on the hand weight in the first direction includes causing rotation of a first portion of the hand weight relative to a second portion of the hand weight in a second direction about the axis.

Implementations can include one or more of the following features or other features described in this disclosure.

In some implementations, a chassis of the hand weight can include a body defining an opening within which the handle portion can be positioned. The body can include an outer surface to which the flexible element or the flexible membrane can be attached.

In some implementations, an opening of the hand weight, e.g., the opening defined by the body or the opening extending through the center of the toroidal structure, can be arranged to extend along the axis of the forearm of the user when the user can be grasping the handle portion.

In some implementations, a width of the opening can be between 50 and 90% of an overall width of the hand weight.

In some implementations, the handle portion can extend from a first portion of the chassis, across the opening, and to a second portion of the chassis.

In some implementations, the handle portion can include a body portion asymmetric relative to a central axis of the hand weight. The body portion can include a convex portion for supporting a contour of a palm of the user and a concave portion for supporting tissue between a thumb and fingers of the user when the user can be grasping the handle portion.

In some implementations, the flexible element or the flexible membrane can be attached to the outer surface of the body along a perimeter of a first end portion of the body and along a perimeter of a second end portion of the body.

In some implementations, the flexible element or the flexible membrane can include spaced-apart raised portions.

In some implementations, the opening defined by the body can extend along an axis from the first end portion of the body to the second end portion of the body. Each of the plurality of spaced-apart raised portions can extend along an entirety of a perimeter of a corresponding cross-section of the hand weight along a plane transverse to the axis of the opening.

In some implementations, the hand weight can further include a loop structure positioned around the chassis and between the flexible element or the flexible membrane and the chassis.

In some implementations, the loop structure can be fixed to a portion of the flexible element or the flexible membrane. The loop structure can be slidably mounted relative to the chassis. The loop structure can be configured to slide relative to the chassis in response to the force applied to the handle portion.

In some implementations, the loop structure can separate a first portion of the cavity from a second portion of the cavity and can include openings connecting the first portion of the cavity to the second portion of the cavity.

In some implementations, the movable mass can be configured to travel through the openings from the first portion of the cavity to the second portion of the cavity in response to the force applied to the handle portion and as the loop structure slides relative to the chassis.

In some implementations, the loop structure can include an inner ring positioned to contact an outer surface of the chassis, an outer ring fixed to the flexible element or the flexible membrane, and support members extending between the inner ring and the outer ring.

In some implementations, the hand weight can include the movable mass. The movable mass can be positioned within the cavity.

In some implementations, the hand weight can include a sealable opening into the cavity, wherein the sealable opening can be configured to provide a conduit for the movable mass into the cavity.

In some implementations, the movable mass can be a fluid, and the sealable opening can be a fluid valve for receiving the fluid.

In some implementations, a mass quantity of the hand weight can be 0.5 kg to 2 kg, and a mass quantity of the movable mass can be at least 40% of the mass quantity of the hand weight.

In some implementations, the cavity can form a loop around a central portion of the hand weight, and the movable mass, when received in the cavity, can be movable about the loop relative to the chassis in response to a torque applied to the handle portion by the user while grasping the handle portion.

In some implementations, the direction can be a first direction, and the movable mass, when received in the cavity, can be movable in a second direction along the axis in response to the force.

In some implementations, a maximum dimension of the hand weight can be no more than 25 centimeters.

In some implementations, the maximum dimension of the hand weight can be between 12 and 20 centimeters.

In some implementations, the flexible element can include a flexible membrane attached to the chassis. The flexible element or the flexible membrane and the chassis can at least partially define a cavity configured to receive the movable mass and configured to support the sprung mass of the hand weight assembly.

In some implementations, the cavity can form a loop around the axis about which at least part of the sprung mass can be movable relative to the chassis in response to a torque applied to the handle portion by the user while grasping the handle portion.

In some implementations, the direction can be a first direction along the axis, the force can be a first force in the first direction along the axis, and the flexible element or the flexible membrane can be configured to deform such that the sprung mass moves in a second direction along the axis relative to the chassis in response to the first force, and deform such that the sprung mass moves in the first direction along the axis relative to the chassis in response to a second force in the second direction along the axis applied by the user while grasping the handle portion.

In some implementations, the flexible element or the flexible membrane can be configured to at least partially support the movable mass such that a first center of gravity of the hand weight assembly can be positioned between a center of a palm of the user and a wrist of the user when the hand weight can be at rest and a second center of gravity of the hand weight assembly can be offset, along the axis, from the first center of gravity of the hand weight assembly in response to the force being applied.

In some implementations, the toroidal structure can include a chassis at least partially defining the cavity. The flexible element or the flexible membrane can be positioned around the chassis and can be attached to the chassis.

In some implementations, a cross section of a tube forming the toroidal structure can be non-circular.

In some implementations, accelerating the hand weight along the axis in the forward direction can include applying a pushing force on the hand weight away from a body of the user. Accelerating the hand weight along the axis in the rearward direction can include applying a pulling force on the hand weight toward the body of the user.

In some implementations, causing the center of gravity of the hand weight to shift along the axis in the rearward direction relative to the hand of the user can include causing movement of a first portion of the hand weight in the rearward direction relative to a second portion of the hand weight.

In some implementations, causing the center of gravity of the hand weight to shift along the axis in the forward direction relative to the hand of the user can include causing movement of the first portion of the hand weight in the forward direction relative to the second portion of the hand weight.

In some implementations, the first portion of the hand weight can include a movable mass and at least a portion of a flexible element or a flexible membrane of the hand weight, and the second portion of the hand weight can include a chassis of the hand weight. The chassis can be grasped by the hand of the user.

In some implementations, causing the movement of the first portion of the hand weight in the rearward direction relative to the second portion of the hand weight includes causing the flexible element or the flexible membrane to deform in the rearward direction relative to the chassis of the hand weight while causing the movable mass to move in the rearward direction within a cavity at least partially defined by the flexible element or the flexible membrane.

In some implementations, applying the force in the forward direction can include applying a pushing force on the hand weight away from a body of the user. Applying the force in the rearward direction can include applying a pulling force on the hand weight toward the body of the user.

In some implementations, the method can further include applying a force on the hand weight along the axis in the rearward direction. Accelerating the hand weight in the rearward direction can include causing the center of gravity of the hand weight to shift along the axis in the forward direction relative to the hand of the user. Causing the center of gravity of the hand weight to shift along the axis in the forward direction relative to the hand of the user can include causing movement of the first portion of the hand weight in the forward direction relative to the second portion of the hand weight.

In some implementations, the method can further include moving the hand weight in a punching motion. Moving the hand weight in the punching motion can include applying the force and applying the torque.

In some implementations, applying the torque in the first direction can include causing the first portion of the hand weight to move about the axis in the first direction about a loop formed in the hand weight.

Advantages of the systems and methods described in this disclosure may include those described below and elsewhere in this disclosure.

In some implementations, the hand weight can be designed for use in dynamic movements across a wide range of fitness and functional sport exercises and can reduce the risk of injury for a user. The hand weight can use sprung weight, ergonomic design, and other mechanisms to minimize rotational inertia about the axis of the forearm, to smooth translational forces over time, and reduce peak translational forces when a user applies a force to the hand weight.

For example, the hand weight can include a movable mass that moves relative to the rest of the hand weight to provide a reduced rotational inertia of the hand weight compared to hand weights without movable masses.

Furthermore, implementations including a flexible element can further reduce peak forces on the forearm or hand of the user. The flexible element can deform in response to the movement of the movable mass, thereby increasing the distance that the movable mass travels and hence decreasing peak forces on the forearm or hand of the user. The flexible element can be shaped in a way, e.g., have a rippled or accordion design, that enables the flexible element to accommodate movement of the volume of the movable mass within the cavity.

In further implementations, the hand weight can include a baffle that guides movement of the movable mass and further regulates the dampening effect of the movement of the movable mass. The baffle itself can be movable relative to part of the hand weight, thereby further providing reduced inertia, e.g., translational inertia, for the overall hand weight as compared to hand weights without the movable baffle.

These mechanisms for and configurations of the hand weight can allow for more vigorous strength, aerobic, and functional training, while protecting joints and weaker muscles from injury. The mechanisms and configurations can prevent muscles involved in wrist pronation and supination from being fatigued prematurely, or injured. In addition, they can provide reduction and smoothing of peak impact forces experienced by the user when the apparatus is accelerated normal to the circular plane of the chassis. This helps prevent injury and allows for more vigorous, comfortable exercise. This can provide some sensation of cushioning and elasticity that can be safer and more enjoyable than dynamic movements with a dead weight.

In some implementations, the hand weight can have improved ergonomics relative to conventional hand weights. A handle portion of the hand weight can be easily grasped by a user and when grasped by the user, can conform to natural geometry of the palm, thumb, and fingers of the user. This can improve user comfort in using the hand weight and can further reduce the risk of injury The details of one or more implementations of the subject matter described in this specification are set forth in the accompanying drawings and the description below. Other potential features, aspects, and advantages will become apparent from the description, the drawings, and the claims.

DETAILED DESCRIPTION

Figure 1A:
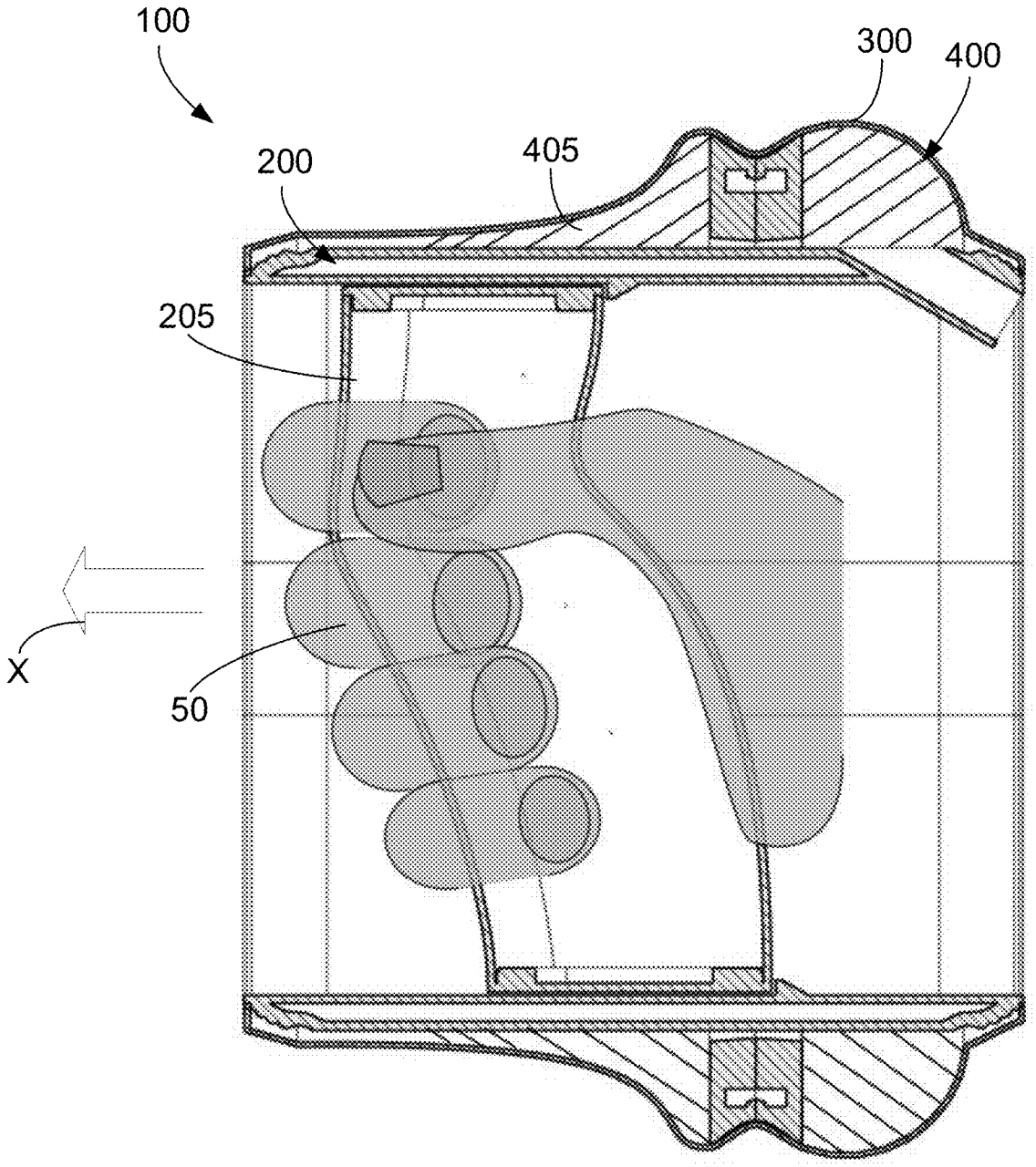
FIG. 1A is a side cross-sectional view of an example of a hand weight in use.

Referring to FIG. 1A, an example of a hand weight 100 includes a chassis 200, a flexible element 300 positioned around the chassis 200, and a cavity 400 positioned around the chassis 200. A movable mass 405 can be positioned within the cavity 400. The movable mass 405 can move in response to a user grasping a handle portion 205 of the chassis 200 (e.g., with a hand 50 of the user) and applying a force and/or torque to the hand weight 100, e.g., during an exercise routine, that causes motion of the hand weight 100 in a direction X. The flexible element 300 (which has a mass quantity in addition to a mass quantity of the movable mass 405) can similarly deform relative to the rest of the hand weight 100 (e.g., due to inertia of the flexible element 300) in response to movement of the hand weight 100 and/or in response to the movement of the movable mass 405 and/or the force and/or torque applied by the user to the hand weight 100. FIG. 1A, in particular, shows the state of the hand weight 100 as the user is accelerating the hand weight 100 in the direction X relative to the body of the user. When the exercise routine is a punching motion, the state of the hand weight 100 depicted in FIG. 1A can be a state of the hand weight 100 as the user performs the portion of the punching motion away from the body of the user.

The hand weight 100 can be used for a variety of exercises in which the user applies the force and/or torque to the hand weight 100. For example, the hand weight 100 can be grasped at the handle portion 205 and then moved in an exercise motion. This exercise motion can involve movement in the direction X (shown in FIG. 1A) and twisting about an axis parallel to the direction X. For example, this exercise motion can be a punching motion applied by the hand 50 of a user. As discussed in this disclosure, the hand weight 100 can dynamically respond to a force and/or torque applied by the user to improve exercise training results from using the hand weight 100 and protect joints and weaker muscles from injury.

Figure 1B:
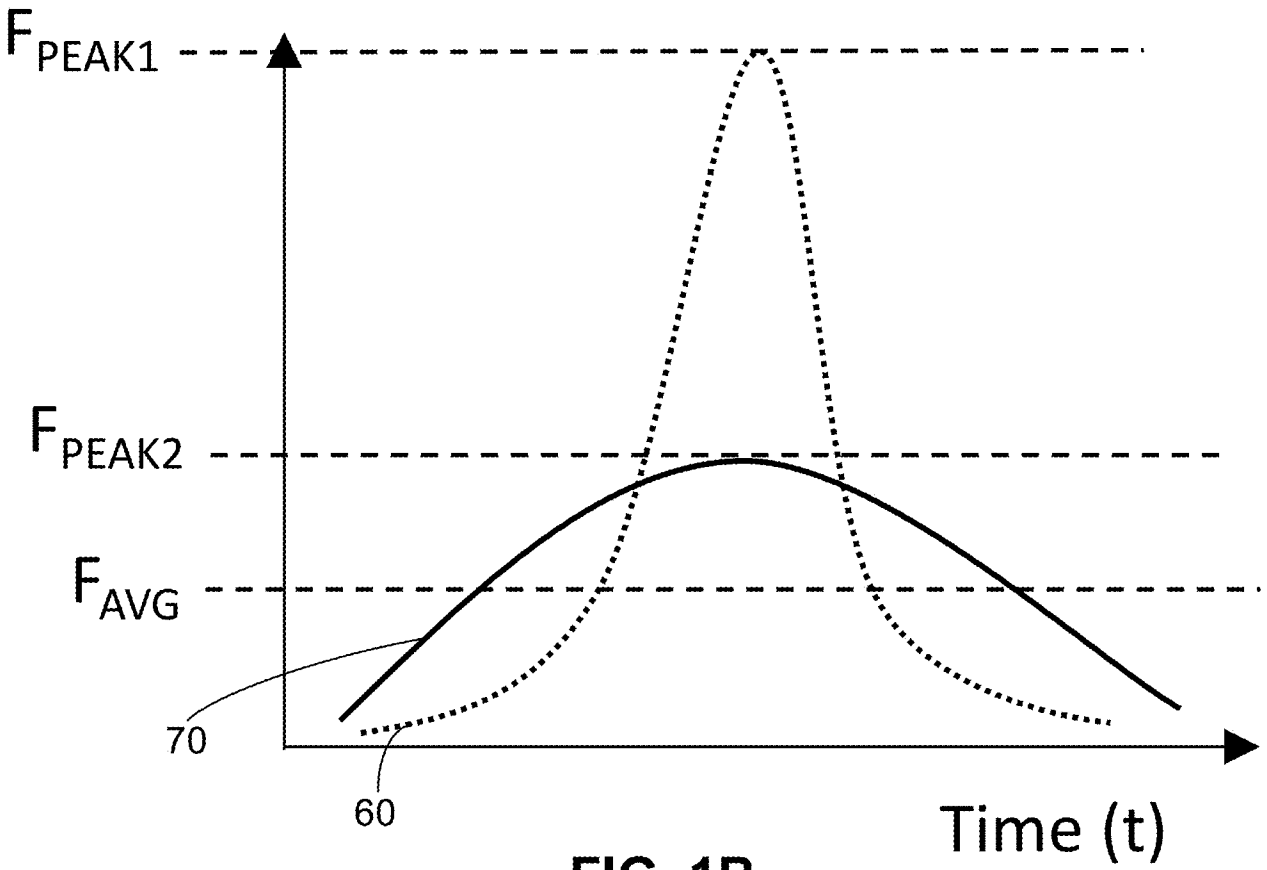
FIG. 1B is a diagram of an example of a peak force experienced by the hand weight of FIG. 1A as compared to a peak force experienced by a conventional hand weight.

FIG. 1B shows a profile 60 of forces experienced by the hand 50 of the user during use of the hand weight 100 and a profile 70 of forces experienced by the hand of the user during use of a conventional hand weight (e.g., a dumbbell with rigid weights on opposite ends of an elongate handle) having the same mass as the hand weight 100. For example, these profiles 60, 70 can correspond to forces experienced by the hand during the portion of a punching motion in which the user accelerates the hand weight in the direction X but before the user begins decelerating the hand weight (e.g., before the user begins accelerating the hand weight in a direction opposite the direction X). During this portion of the punching motion, the hand experiences a peak force due to the pushing force applied by the user. These profiles 60, 70 assume that the user performs the punching motion in the same manner for the hand weight 100 and the conventional hand weight, e.g., over the same distance and over the same amount of time. As shown in FIG. 1B, an average force ($F_{AVG}$) experienced by the hand 50 of the user during use of the hand weight 100 and an average force ($F_{AVG}$) experienced by the hand of the user during use a conventional hand weight can be the same. As a result, the work performed by the hand of the user would be the same for both the hand weight 100 and the conventional hand weight. Peak forces can be different. For example, a peak force ($F_{PEAK1}$) experienced by the hand 50 of the user during use of the hand weight 100 can be less than a peak force ($F_{PEAK2}$) experienced by the hand of the user during use of the conventional hand weight. This reduction in peak forces during use of the hand weight 100 can reduce the likelihood of injury for the user when using the hand weight 100, as compared to the likelihood of injury for the user when using the conventional hand weight.

Example Hand Weights

Figure 2A:
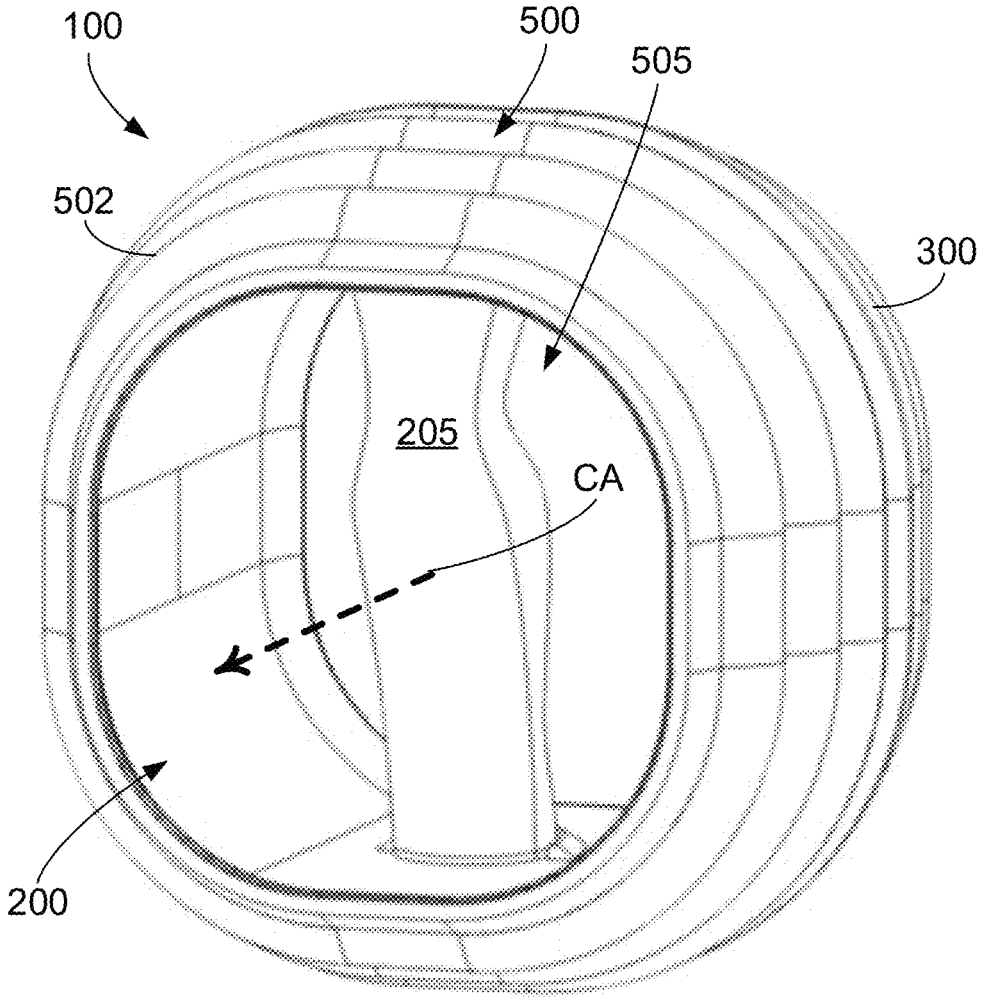
FIGS. 2A-2H are front perspective, rear perspective, front, rear, left side, right side, perspective cross-sectional, and side cross-sectional views, respectively, of the example of the hand weight of FIG. 1.
Figure 2B:
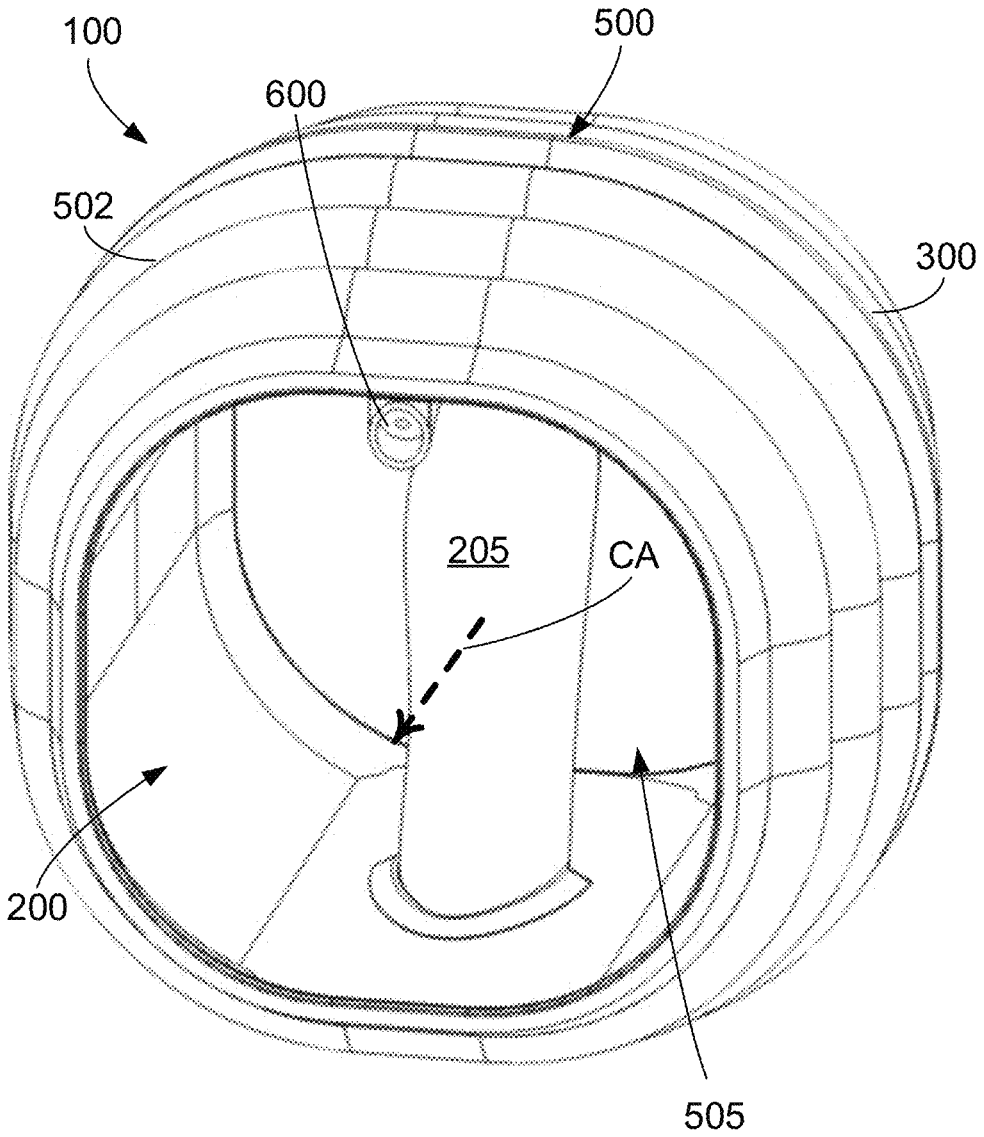
Figure 2C:
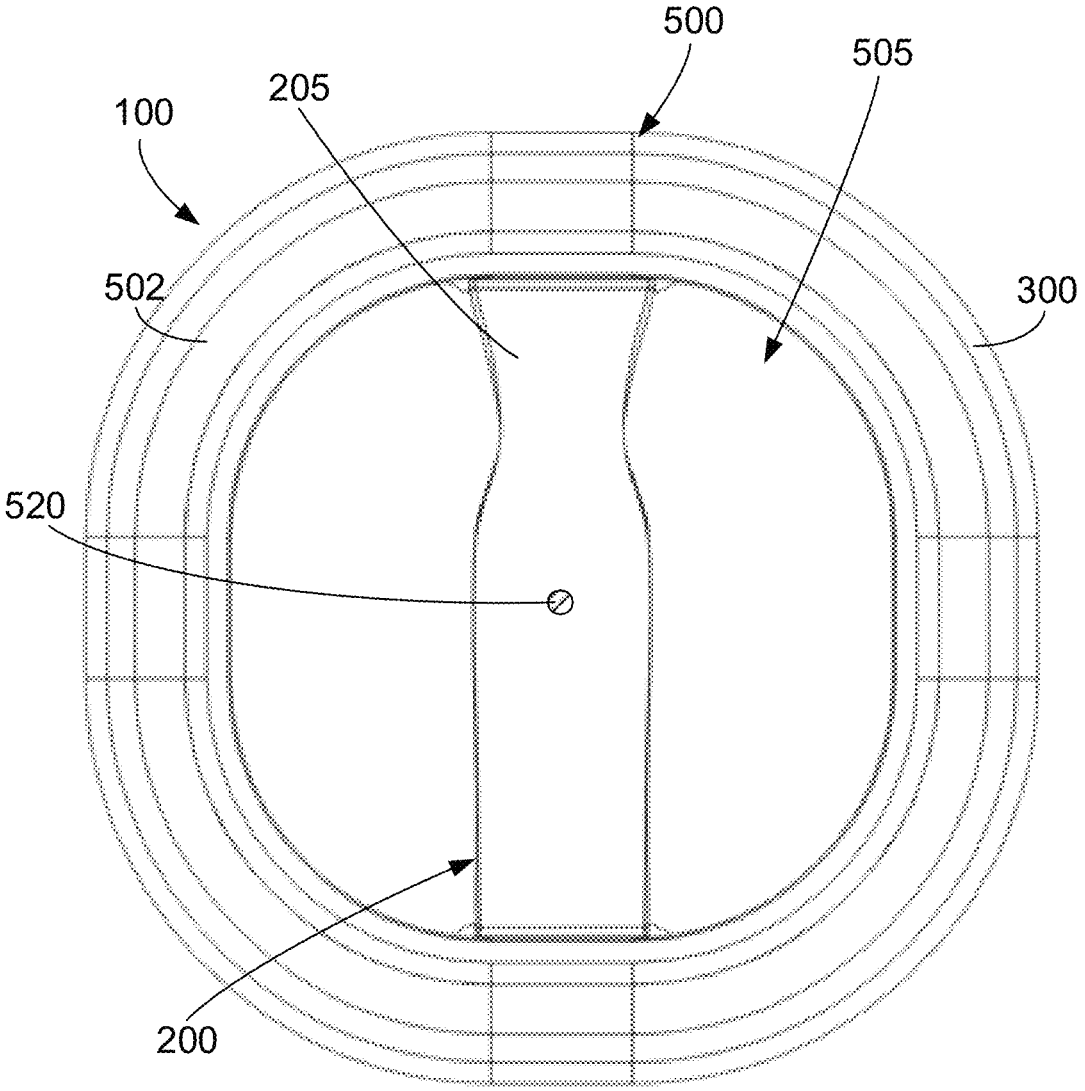
Figure 2D:
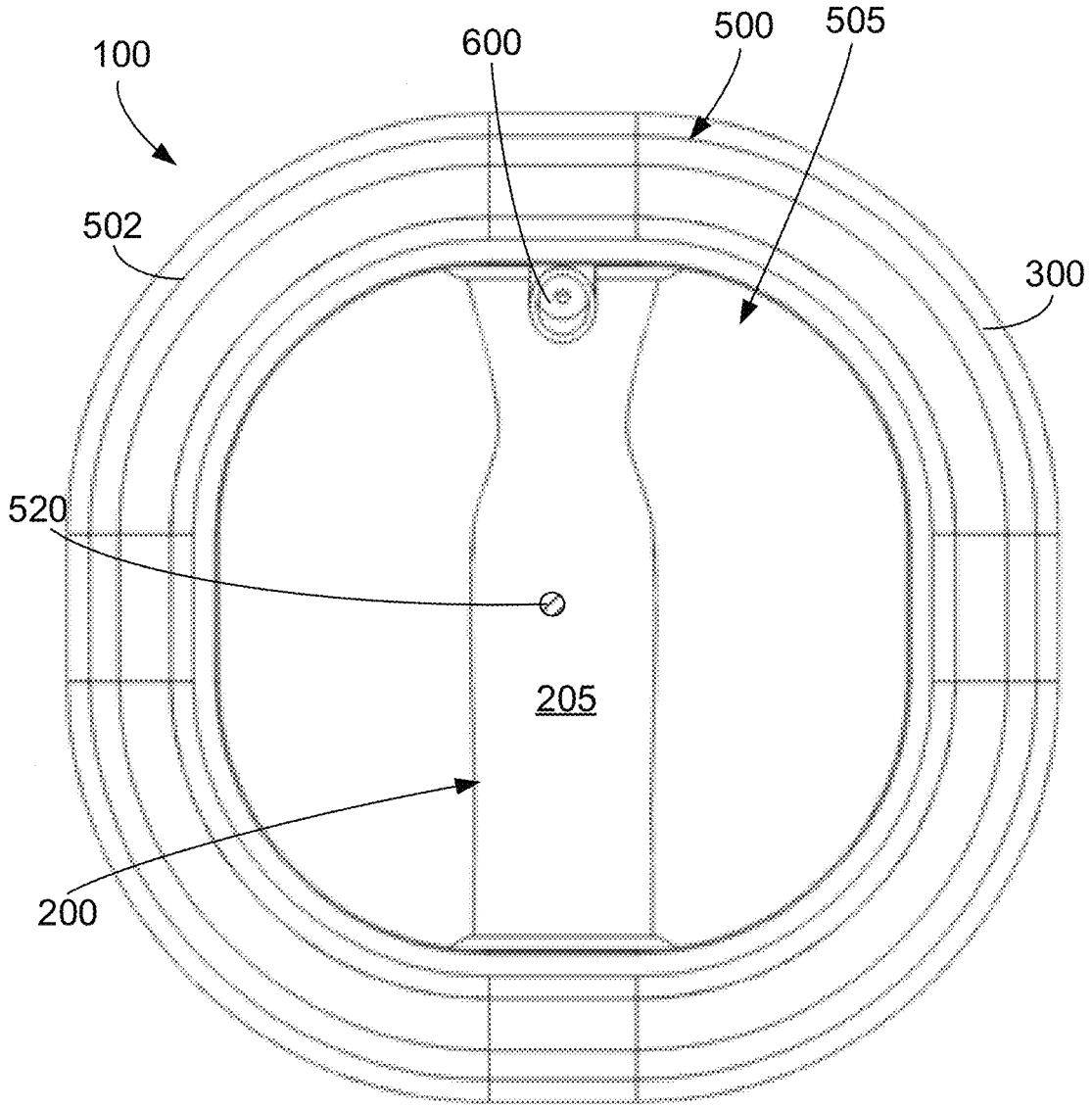
Figure 2E:
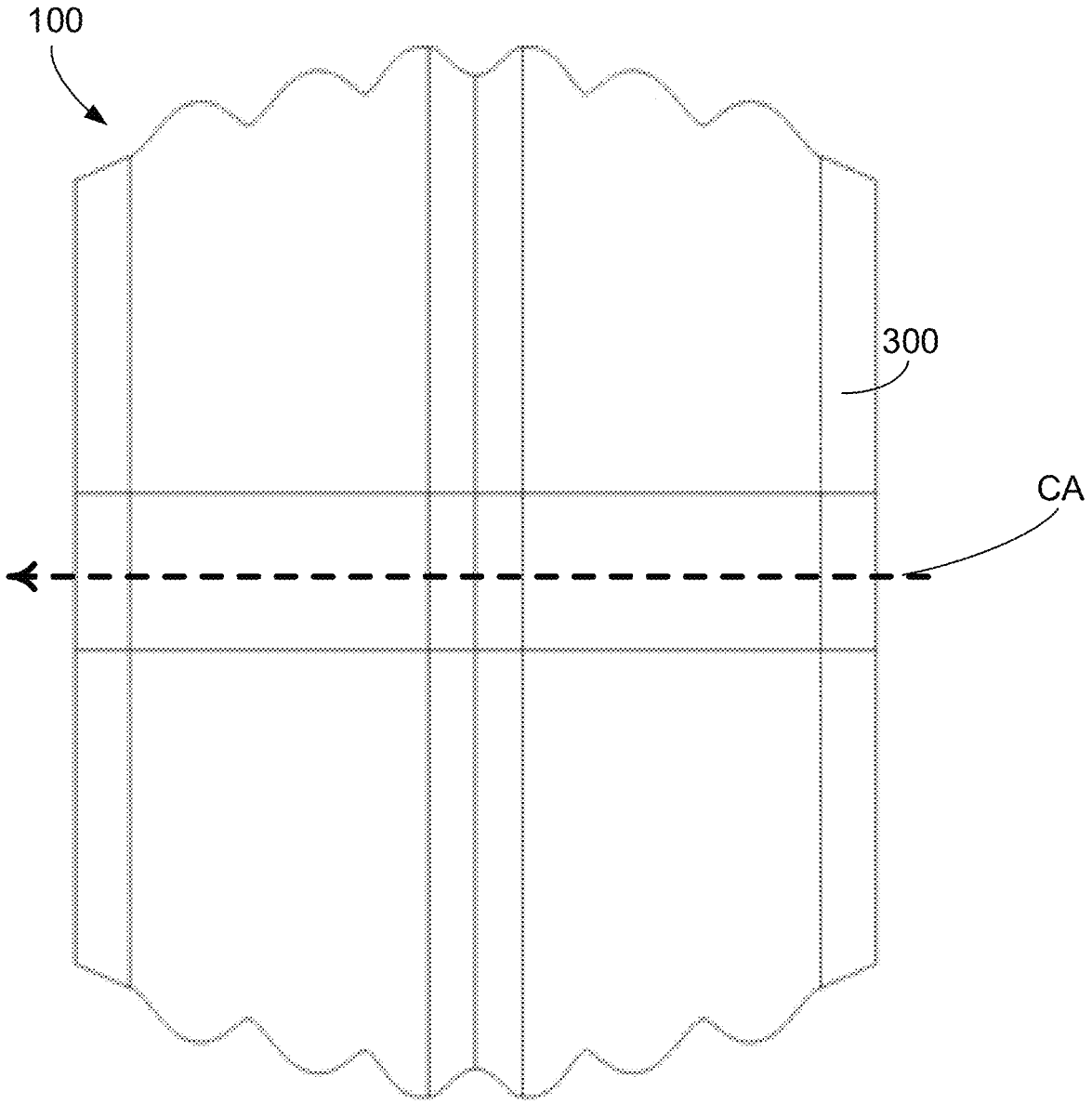
Figure 2F:
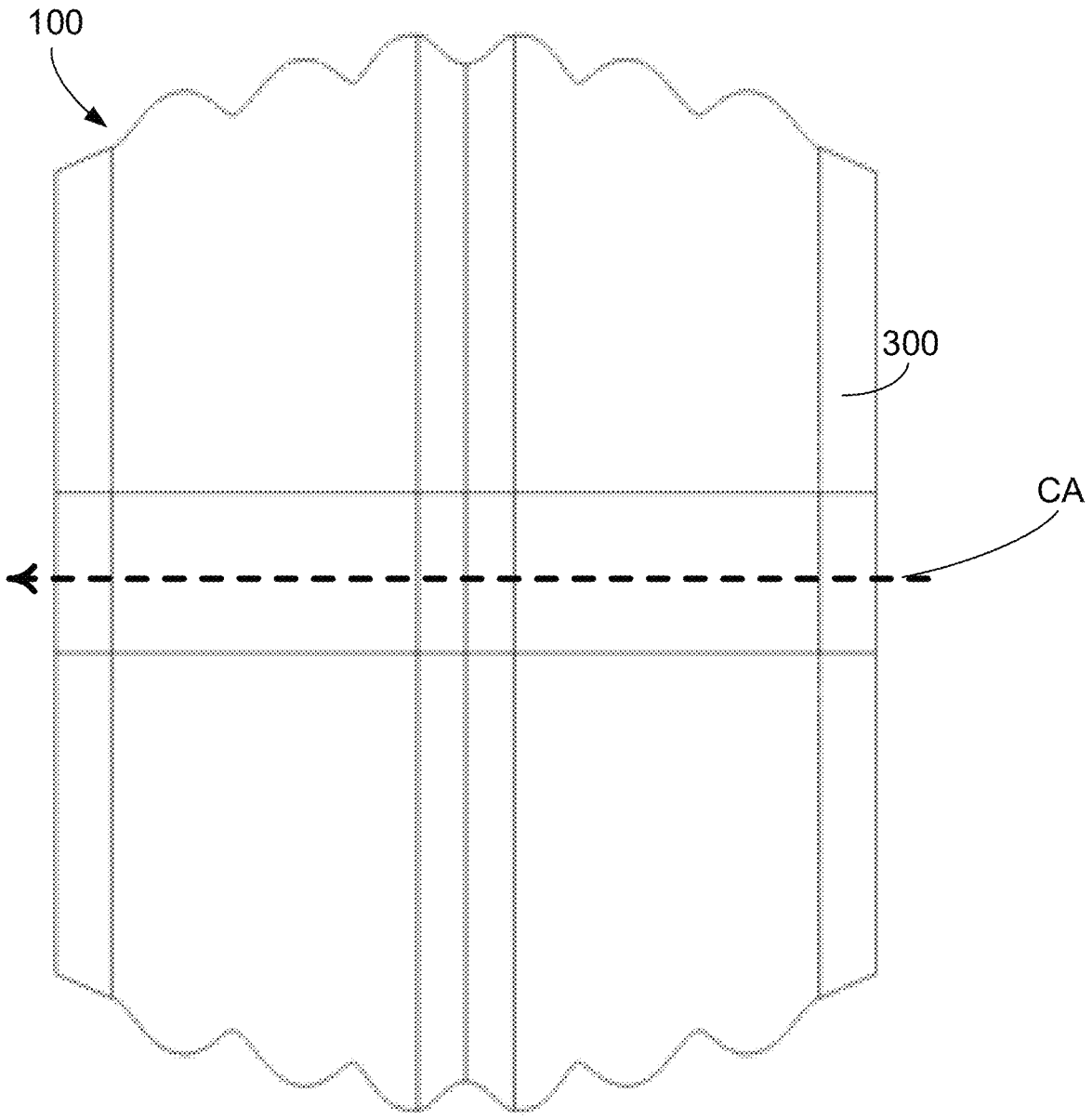
Figure 2G:
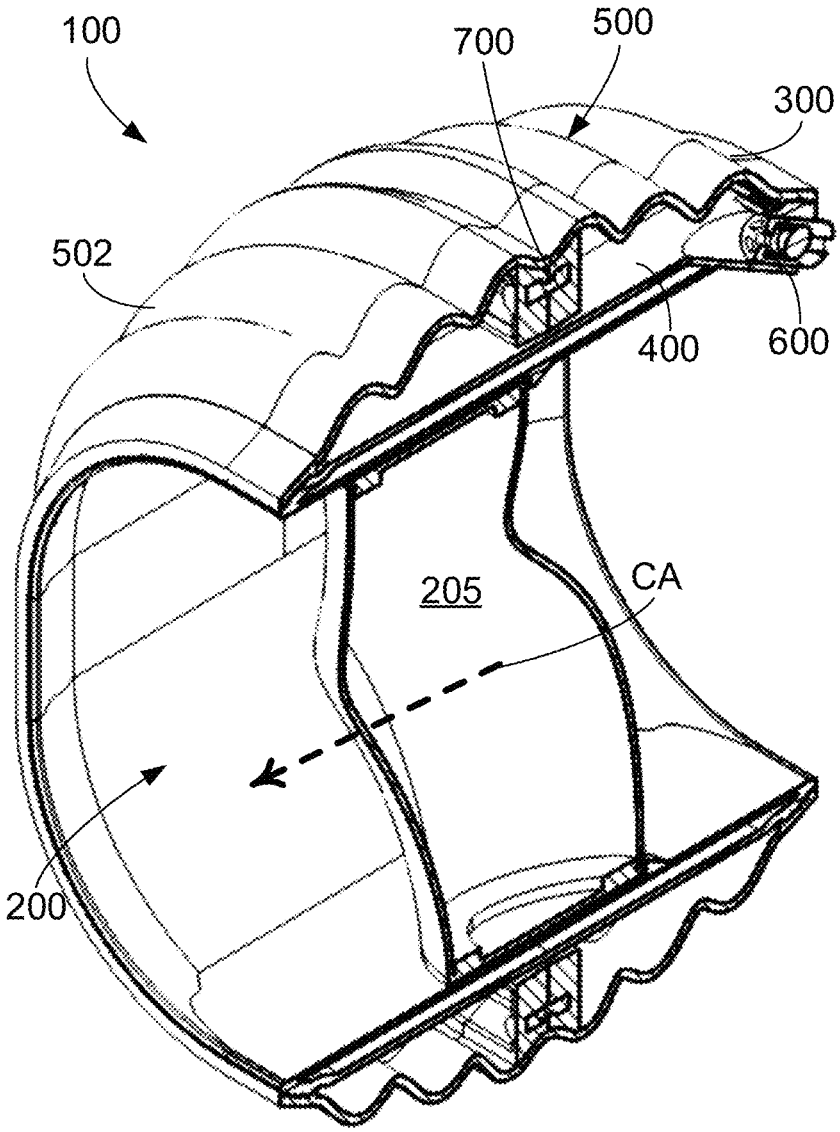
Figure 2H:
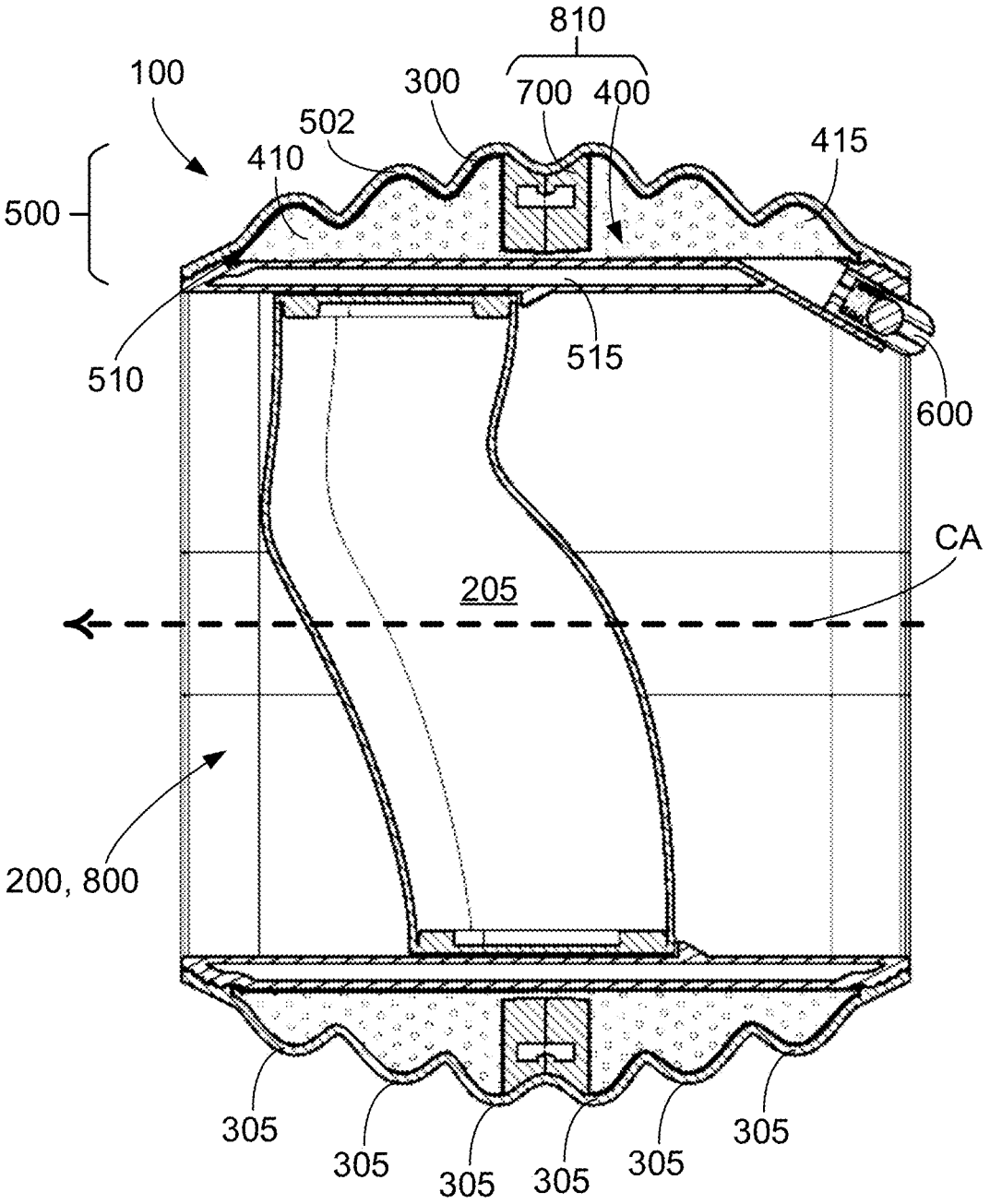

Referring to FIGS. 2A-2H, the hand weight 100 includes a toroidal structure 500 whose interior includes the cavity 400 for accommodating the movable mass 405 (shown in FIG. 2H). The chassis 200 and the flexible element 300 at least partially define, e.g., entirely define, a toroidal structure 500, with the flexible element 300 at least partially defining, e.g., entirely defining, the cavity 400 within an outer surface 502 of the toroidal structure 500.

The handle portion 205 of the chassis 200 is attached to or integral to at least part of the toroidal structure 500. The handle portion 205, for example, extends from a first part of the toroidal structure 500 (e.g., a first part of the chassis 200) to a second part of the toroidal structure (e.g., a second part of the chassis 200). The handle portion 205 is configured to be grasped by the user such that a forearm of the user extends along an axis that is parallel to or coincident with the central axis CA.

The toroidal structure 500 can further define an opening 505 extending through a center 520 (shown in FIG. 2C) of the toroidal structure 500 and through the central axis CA. The opening 505 can extend through at least part of the hand weight 100 along the central axis CA. In the example shown in FIGS. 2A-2H, the opening 505 extends through an entirety of the hand weight 100. The opening 505 provides access to the handle portion 205 for the user, allowing the user to grasp the handle portion 205 and thus use the hand weight 100 for an exercise. Because the opening 505 is a through-hole, the handle portion 205 can be accessed from both ends of the opening 505.

The cavity 400 is configured to receive the movable mass 405 and store the movable mass 405. The cavity 400 is sealed from an exterior of the hand weight 100 such that the movable mass 405 remains in the cavity 400 during use.

The cavity 400 within the toroidal structure 500 can be ring-shaped, thereby allowing the movable mass 405 to travel rotationally about a central axis CA (shown in FIG. 2A) of the hand weight 100. The cavity 400 is positioned around the central axis CA and is positioned around the chassis 200. In the example shown in FIG. 2A-2H, the cavity 400 is a continuous cavity positioned around and extending around an entirety of the central axis CA and an entirety of the chassis 200. The cavity 400 forms a loop about the central axis CA. The central axis CA can be parallel to and/or coincident with the direction X (shown in FIG. 1) that the hand weight 100 is operated.

Referring to FIG. 2H, a cross-section of a tube 510 forming the toroidal structure 500 and the cavity 400 is non-circular, e.g., has a non-circular perimeter. For example, an inner portion 515 of the cross-section of the tube 510 can be flat, while an outer portion of the cross-section of the tube 510 (e.g., defined by the outer surface 502 of the toroidal structure 500) has an irregular geometry.

The movable mass 405 within the cavity 400 is configured to move relative to the toroidal structure 500. In particular, the movable mass 405 can move relative to the chassis 200 and the flexible element 300 as the force and/or torque is applied to the hand weight 100 during an exercise routine. The movable mass 405, when moved relative to the chassis 200 and the flexible element 300, can further cause deformation of the flexible membrane in response to the force and/or torque.

The movable mass 405 is flowable material contained within the cavity 400. The flowable material can include a solid, a fluid, or a combination of both a solid and a fluid. In examples in which the flowable material includes a solid flowable material, the solid flowable material can be formed of granules of solid material. Each granule can have a maximum dimension sized to enable flow of the flowable solid material during application of force and/or torque by the user. For example, in implementations, the maximum dimension can be no more than 15 millimeters, e.g., no more than 10 millimeters, no more than 5 millimeters, no more than 2.5 millimeters, no more than 1 millimeter, no more than 0.5 millimeters, etc. In other implementations, the flowable material can include a flowable fluid, e.g., water, oil, or other appropriate liquid.

The hand weight 100, e.g., the chassis 200 of the hand weight 100, can include a sealable opening 600 (shown in FIGS. 2B, 2D, and 2G-2H) that enables the movable mass 405 to be received in the cavity 400, maintains the movable mass 405 within the cavity 400, and prevents the movable mass 405 from escaping the cavity 400 to an exterior environment of the hand weight 100. The sealable opening 600 can be an opening with a cap attachable to the hand weight 100 to seal the opening. In implementations in which the movable mass 405 is a fluid, the sealable opening 600 is a fluid valve for receiving the fluid within the cavity 400. The sealable opening 600 allows a user to fill, replace, and remove the movable mass 405, thus allowing the hand weight 100 to be more easily transported and stored.

In some implementations, the hand weight 100 can further include a movable component in addition to the movable mass 405 and the flexible element 300 that controls movement of the movable mass 405 and/or the flexible element 300. For example, the movable component in the example of the hand weight 100 can be a baffle 700 (shown in FIGS. 2G and 2H). The baffle 700 is movable relative to the chassis 200 in response to the force and/or torque applied by the user. The baffle 700 can be movably mounted around the chassis 200. In some implementations, the baffle 700 contacts the chassis 200, while in other implementations, the chassis 200 is separated from the chassis 200 by a distance, e.g., by 1 to 10 millimeters. The baffle 700 is affixed to a portion of the flexible element 300, e.g., welded, glued, or fixed to the flexible element 300 using some other appropriate method.

The baffle 700 separates the cavity 400 into a first portion 410 and a second portion 415 (shown in FIG. 2H). The baffle 700 provides a conduit between the first portion 410 and the second portion 415 of the cavity 400, thereby allowing a first portion of the movable mass 405 within the first portion 410 of the cavity 400 to travel to the second portion 415 of the cavity 400 and allowing a second portion of the movable mass 405 within the second portion 415 of the cavity to travel to the first portion 410 of the cavity 400. During use of the hand weight 100, the baffle 700 can move in a direction parallel to the central axis CA. As described in greater detail in this disclosure, the baffle 700 partially restricts free flow of the movable mass 405 in directions parallel to the central axis CA, thereby providing a dampening effect on the overall force and/or torque experienced by the user during use of the hand weight 100.

The structure of the hand weight 100 includes an unsprung mass 800 (shown in FIG. 2H), e.g., directly handled by the user, and a sprung mass 810 (shown in FIG. 2H). The sprung mass 810 includes the movable mass 405, the baffle 700, and the flexible element 300, and the unsprung mass includes the chassis 200. The sprung mass 810 is configured to move relative to the unsprung mass 800 as the user applies the force and/or torque to the hand weight 100. Thus although the sprung mass 810 contributes to the overall mass of the hand weight 100, the motion of the sprung mass 810 relative to the unsprung mass 800 can smooth out forces and/or torques felt by the user over the entire motion of an exercise. In particular, the sprung mass 810 is configured to move relative to the chassis 200 in response to the force and/or torque applied to the handle portion 205 by the user while the user grasps the handle portion 205.

Figure 4:
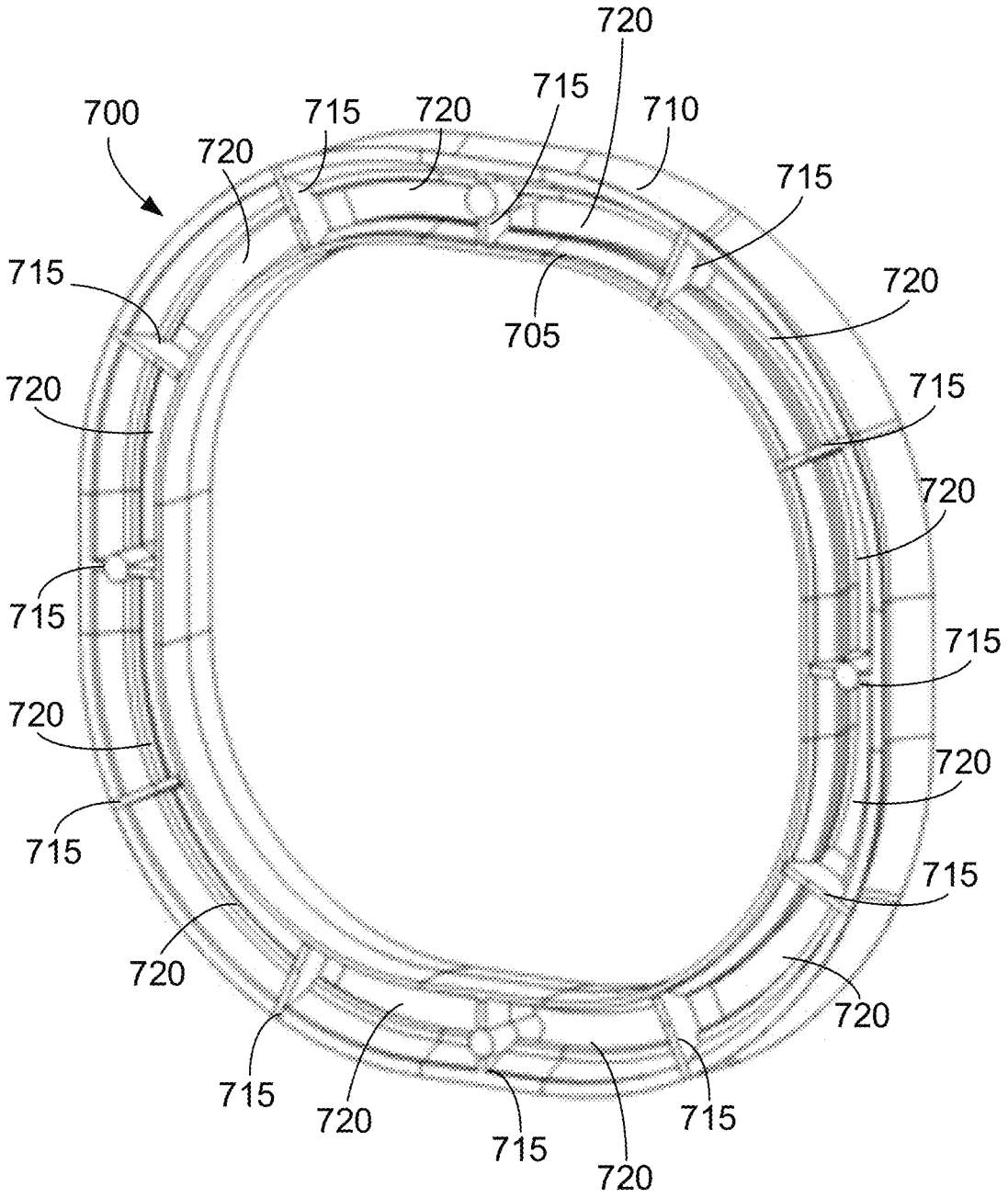
FIG. 4 is a perspective view of a baffle of the example of the hand weight of FIG. 1.
Figure 5:
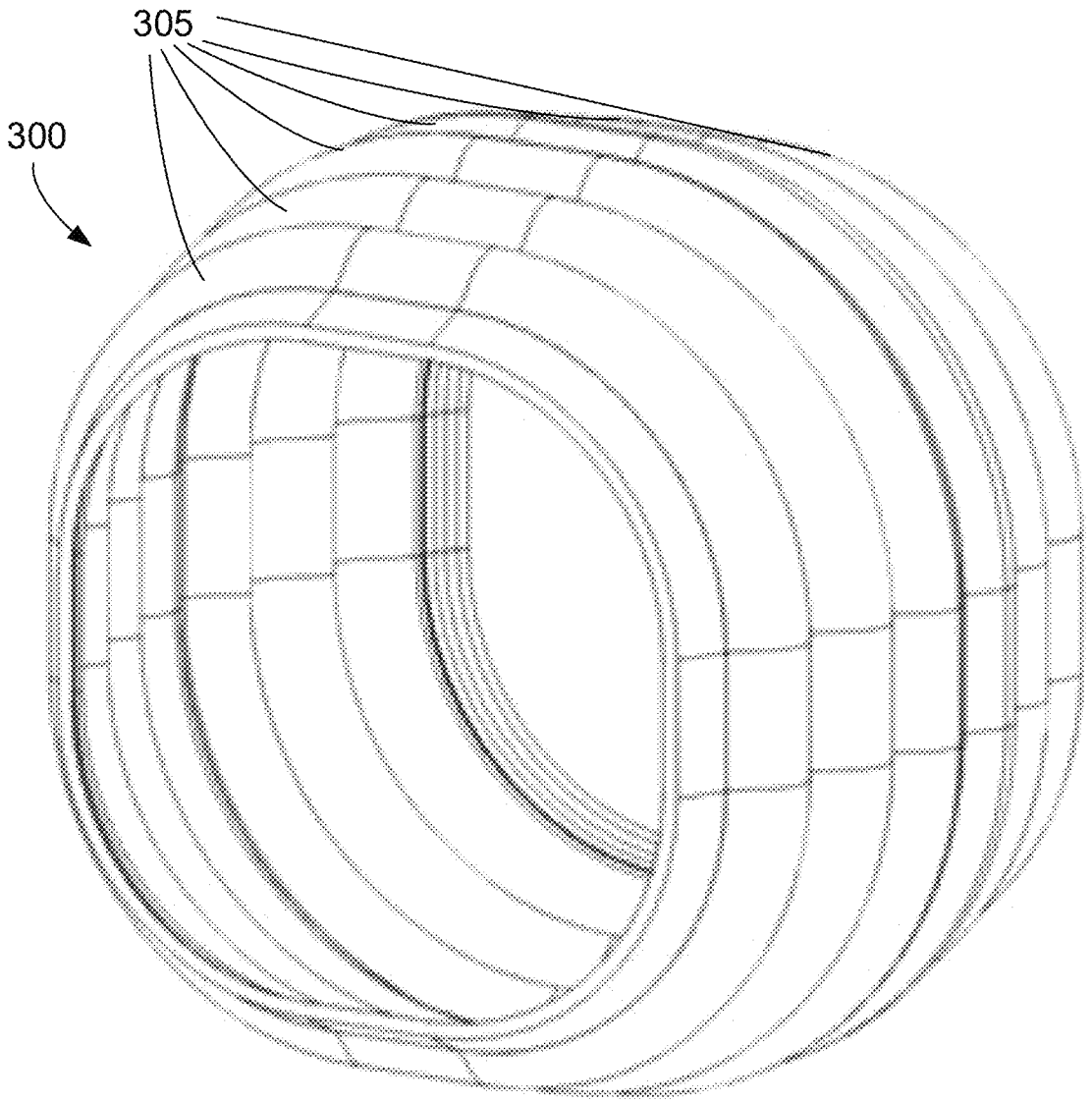
FIG. 5 is a perspective view of a flexible membrane of the example of the hand weight of FIG. 1.
Figure 6:
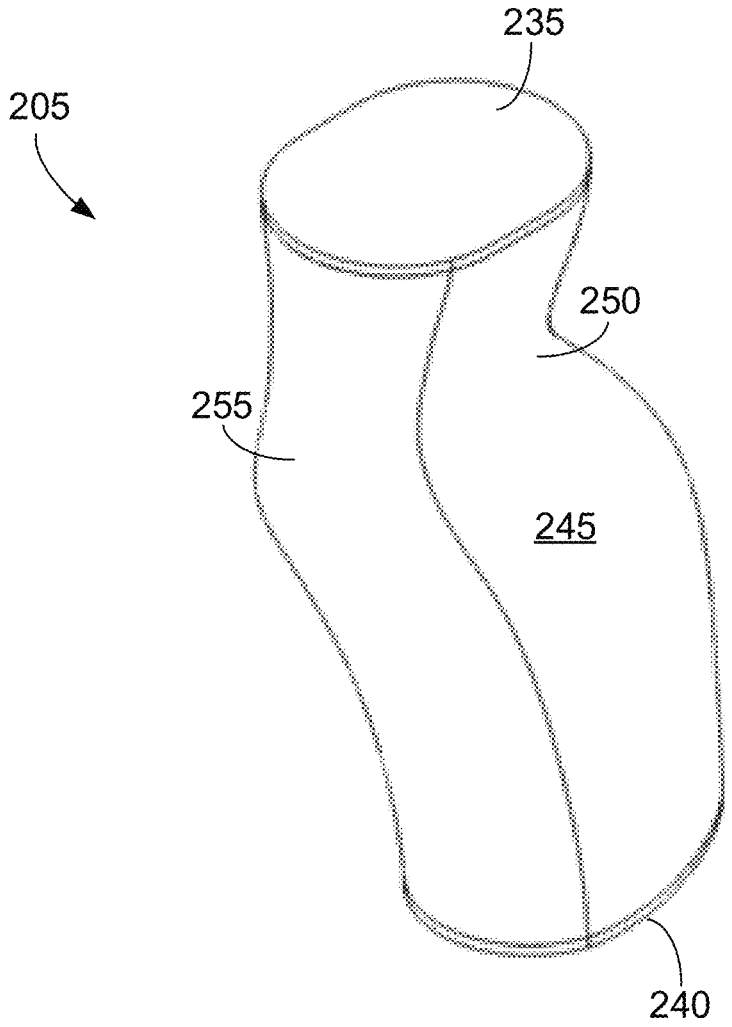
FIG. 6 is a perspective view of a handle portion of the example of the hand weight of FIG. 1.

FIGS. 3-6 illustrate individual components of the hand weight 100, including a body 210 of the chassis 200 (FIG. 3), the baffle 700 (FIG. 4), the flexible element 300 (FIG. 5), and the handle portion 205 (FIG. 6).

Figure 3:
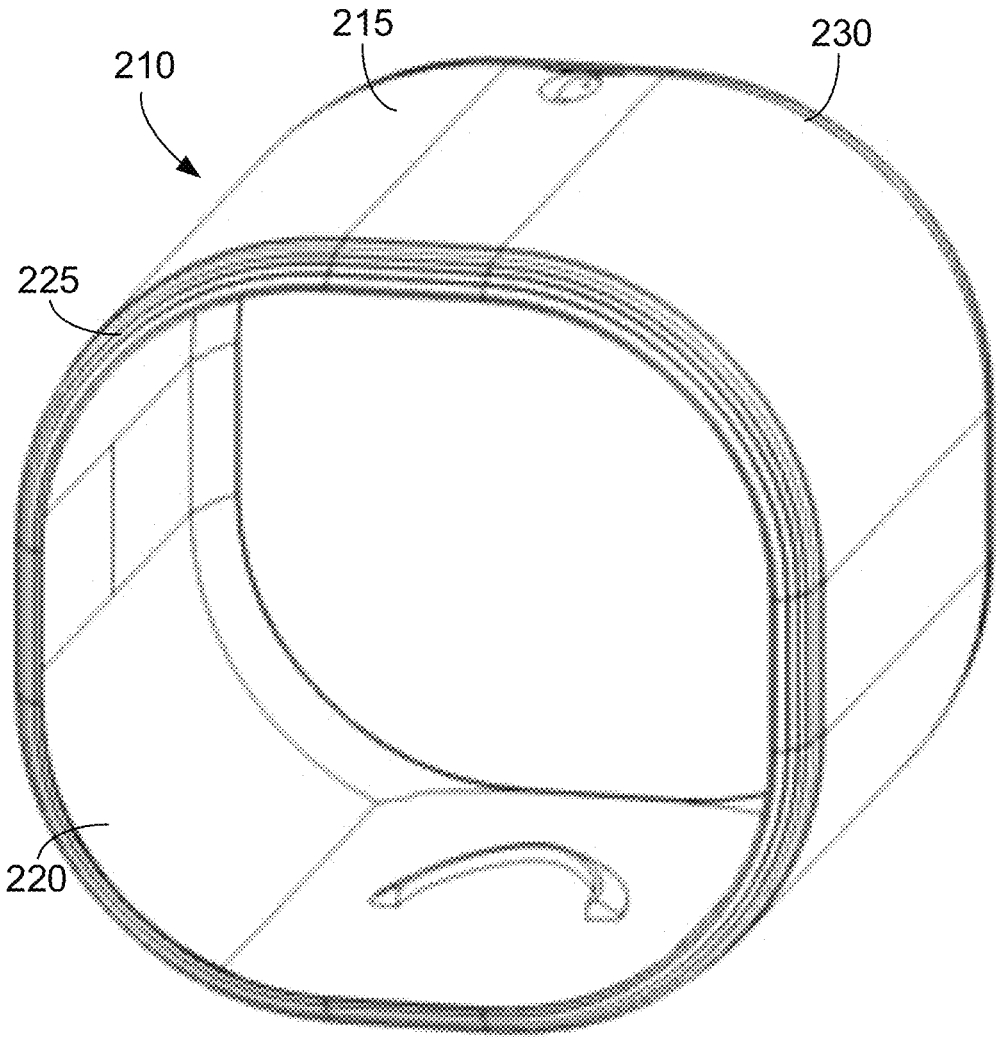
FIG. 3 is a perspective view of a body of the example of the hand weight of FIG. 1.

Referring to FIG. 3, the body 210 is part of the chassis 200, along with the handle portion 205. The body 210 is a ring-shaped structure that extends around the central axis CA (shown in FIG. 2A) of the hand weight 100. The body 210 defines the opening 505 within which the handle portion 205 is positioned. In particular, the handle portion 205 extends along an axis that is perpendicular to the central axis CA such that when the user grasps the handle portion 205, the axis of the forearm of the user is parallel to the central axis CA. In particular, when the user grasps the handle portion 205, the cavity 400 and the movable mass 405 are positioned around the user's forearm and the axis of the forearm. The opening 505 extends along the axis of the forearm of the user when the user is grasping the handle portion 205. A width of the opening 505, e.g., a dimension of the opening 505 along an axis perpendicular to the central axis CA, is between 50% and 90% of an overall width of the hand weight 100, e.g., between 60% and 80%, or about 60%, about 70%, or about 80% of the overall width of the hand weight 100.

The body 210 includes an outer surface 215 and an inner surface 220. The outer surface 215 at least partially defines the cavity 400 (shown in FIGS. 2G and 2H) and is in contact with the movable mass 405 (shown in FIG. 2H) when the movable mass 405 is received within the cavity 400. In addition, the flexible element 300 is attached to the outer surface 215. For example, the body 210 includes a first end portion 225 and a second end portion 230, and the flexible element 300 can be attached to the outer surface 215 along the first end portion 225 and the second end portion 230, e.g., along an entire perimeter of the first end portion and an entire perimeter of the second end portion 230. The flexible element 300 is attached to the outer surface 215 so as to seal the movable mass 405 in the cavity 400. The inner surface 220 at least partially defines the opening 505 (shown in FIG. 2A). The handle portion 205 is attached to the inner surface 220. In the example shown in FIGS. 2A-2H, the handle portion 205 is attached along the inner surface 220 of the body 210 at two opposing points.

Figure 7:
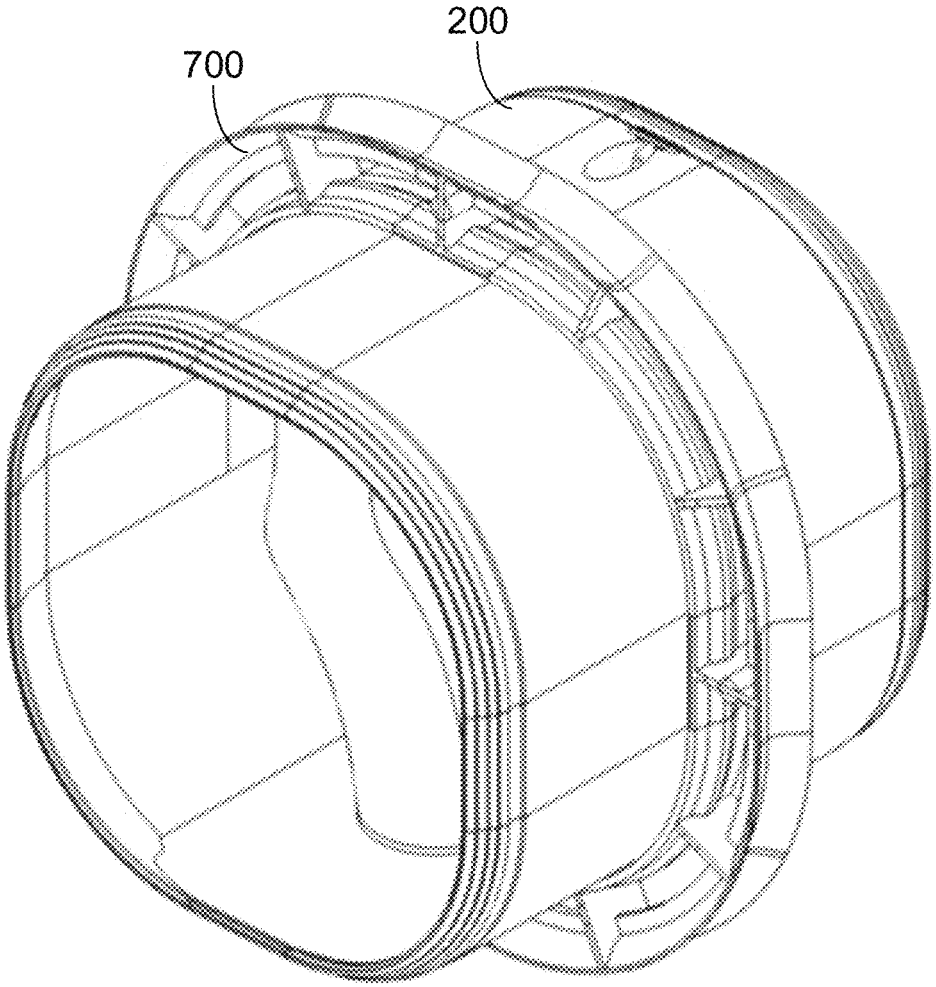
FIG. 7 is a perspective view of the example of the hand weight of FIG. 1 with the flexible membrane removed.
Figure 8:
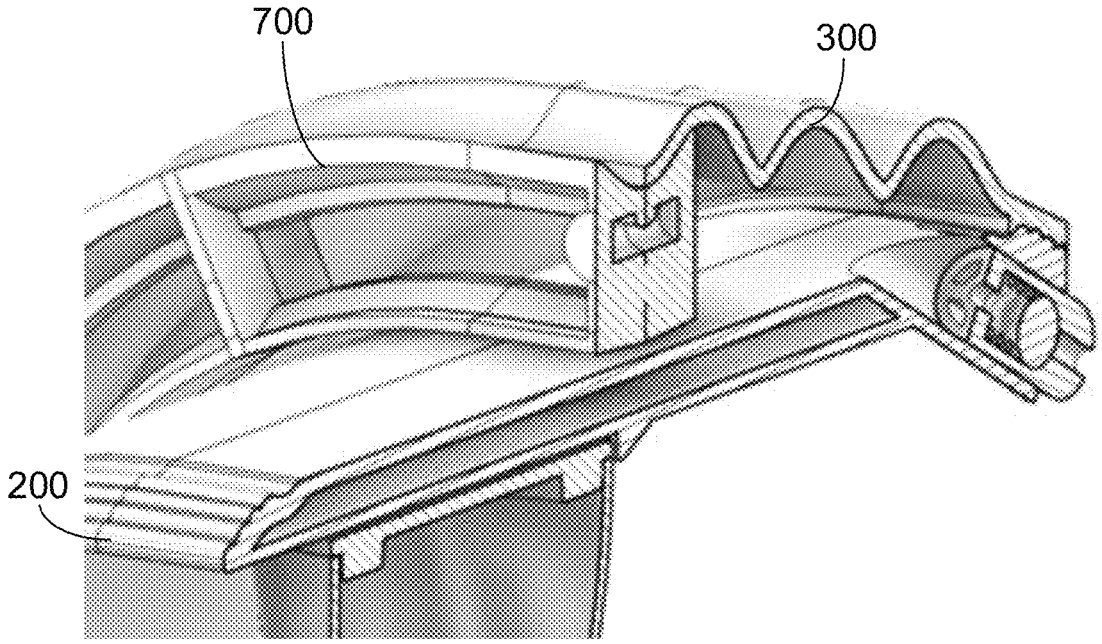
FIG. 8 is a zoomed-in perspective view of an interface between the baffle and the body of the example of the hand weight of FIG. 1.

Referring to FIG. 4, the baffle 700 is a loop structure. FIG. 7 illustrates an interface between the baffle 700 and the chassis 200, and FIG. 8 illustrates an interface between the baffle 700 and the flexible element 300 and the interface between the baffle 700 and the chassis 200. Referring to FIGS. 4, 7, and 8, the baffle 700 is positioned around the chassis 200 and positioned around the central axis CA. In particular, the baffle 700 is positioned along and around the outer surface 215 of the body 210 of the chassis 200. The baffle 700 is positioned between the flexible element 300 and the chassis 200. The baffle 700 is fixed to a portion of the flexible element 300 and is slidably mounted relative to the chassis 200. the baffle 700 is mounted to the flexible element 300 in such a way that the baffle 700 can move relative to the outer surface 215 of the body 210.

In the example shown in FIG. 4, the baffle 700 includes an inner ring 705 and an outer ring 710. The inner ring 705 is slidable relative to the outer surface 215 of the body 210. The inner ring 705 can be in contact with the outer surface 215 of the body 210. In some implementations, the inner ring 705 can be spaced apart from the outer surface of the body 210 by a distance, e.g., by 1 to 10 millimeters. The outer ring 710 is affixed to the flexible element 300.

Support members 715 extend between the inner ring 705 and the outer ring 710. The support members 715 are spaced apart from one another along an outer surface of the inner ring 705 and along an inner surface of the outer ring 710. In some implementations, the support members 715 are uniformly spaced apart while in other implementations, the support members 715 are irregularly spaced apart.

As described above, the baffle 700 separates the first portion 410 of the cavity 400 from the second portion 415 of the cavity 400 (shown in FIG. 2H), e.g., along a plane that is perpendicular to the central axis CA and divides the baffle 700. The support members 715, the inner ring 705, and the outer ring 710 define openings 720 that are between the first portion 410 and the second portion 415 of the cavity 400 and that connect the first portion 410 of the cavity 400 to the second portion 415 of the cavity 400. The openings 720 allow at least some of the movable mass 405 to travel between the first portion 410 and the second portion 415 of the cavity 400 during use of the hand weight 100. In addition, because the baffle 700 is slidably mounted relative to the chassis 200, the baffle 700 can travel along the outer surface 215 of the body 210 to change relative sizes of the first portion 410 and the second portion 415 of the cavity 400 and cause the movable mass 405 to travel between the first portion 410 and the second portion 415 as the first portion 410 and the second portion 415 are resized.

Referring to FIG. 5, the flexible element 300 is a flexible membrane that can deform in response to a force, e.g., in response to movement of the hand weight 100 and/or in response to a force applied by the movable mass 405 as the movable mass 405 moves within the cavity 400. The flexible element 300 has inertia that can cause it to deform relative to the body 210 (shown in FIG. 3) in response to movement of the hand weight 100, and similarly, the inertia of the movable mass 405 can cause the flexible element 300 to deform during this movement of the hand weight 100. The flexible element 300, as described in this disclosure, is positioned around and attached to the chassis 200 in a manner that seals the movable mass 405 within the cavity 400. The flexible element 300 is a ring-shaped structure that fits around the chassis 200. The flexible element 300 can be formed of a rubber or elastomer material that has greater elasticity than the material of the chassis 200, which can be formed of a rigid polymer or metal material.

In the example shown in FIG. 5 (and also shown in FIG. 2H), the flexible element 300 includes multiple spaced-apart raised portions 305. These spaced-apart raised portions 305 allow the flexible element 300 to be designed to include more overall material than in implementations in which the flexible element 300 is a membrane that attaches to the first end portion 225 and the second end portion 230 of the body 210 without the spaced-apart raised portion 305. The spaced-apart raised portions 305 can impart greater flexibility to the flexible element 300, particularly in a direction along the central axis CA, thereby allowing the flexible element 300 to more easily deform in response to the movement of the hand weight 100.

Each of the spaced-apart raised portions 305 can extend along an entirety of a perimeter of a corresponding cross-section of the hand weight 100 along a corresponding plane transverse to the central axis CA. Furthermore, a spacing between the spaced-apart raised portions 305 from peak to peak can be at least 0.5 centimeters, e.g., at least 1 centimeter, at least 2 centimeters, etc. A quantity of the spaced-apart raised portions 305 can be between 2 and 50, e.g., between 2 and 10, between 2 and 15, between 2 and 20, between 5 and 10, between 10 and 15, etc. During use, the flexible element 300 can be stretched and compressed and cause the spaced-apart raised portions 305 to be stretched and compressed. When stretched, the spaced-apart raised portions 305 may be flattened.

Referring to FIG. 6, the handle portion 205 includes a first end portion 235, a second end portion 240, and a body portion 245 extending between the first end portion 235 and the second end portion 240. The first end portion 235 is attached to a first portion of the chassis 200, and the second end portion 240 is attached to a second portion of the chassis 200 (for example, as depicted in FIG. 2A). The body portion 245 of the handle portion 205 extends across the opening 505. An overall length of the handle portion 205 can be between 10 and 15 centimeters. An overall thickness of the body portion 245 can taper from the second end portion 240 to the first end portion 235 to reduce the likelihood of flexion of the wrist of the user and thereby reduce the risk of injury of the wrist.

The body portion 245 is asymmetrically arranged around the central axis CA and is asymmetrically arranged around an axis transverse to the central axis CA. Contours of the body portion 245 are designed such that the body portion 245 can be comfortably grasped by the user in only one orientation by either hand of the user. For example, the body portion 245 includes a concave portion 250 that is sized, dimensioned, and shaped for tissue between a thumb and fingers of the user and a convex portion 255 that is sized, dimensioned, and shaped for fingers of the user. The convex portion 255 extends around the body portion 245 and is similarly sized, dimensioned, and shaped for a palm of the user. The concave portion 250 and the convex portion 255 are arranged such that, when grasped by the user, the axis of the forearm of the user is oriented to be perpendicular to the axis along which the handle extends and is oriented to be parallel to the central axis CA.

Example Methods of Using Hand Weights and Examples of Hand Weights in Use

In implementations, a hand weight can be used in methods that allow for a center of gravity of the hand weight to shift relative to a hand of a user along an axis along which the hand weight is moved by a user during an exercise motion. In particular, in contrast to conventional hand weights (e.g., a dumbbell with weights rigidly attached to a handle portion), in implementations in this disclosure, a method of using a hand weight can include shifting the center of gravity of the hand weight relative to a hand of the user in response to forces applied by the user.

Figure 9C:
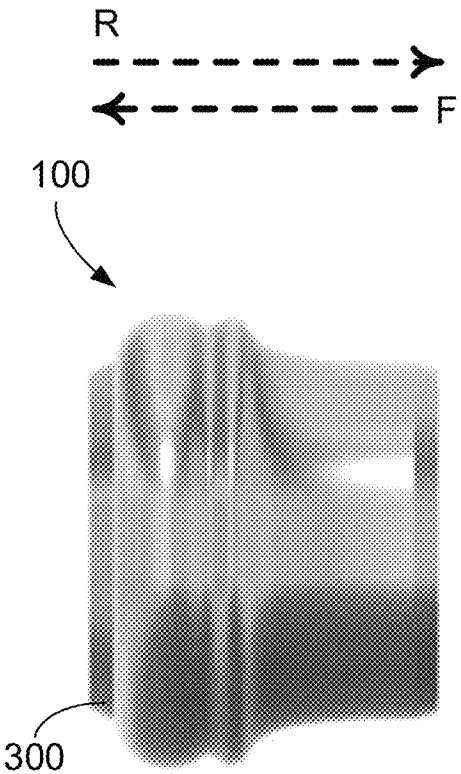
FIGS. 9A-9C are side views of the example of the hand weight of FIG. 1 in first, second, and third states, respectively.
Figure 9B:
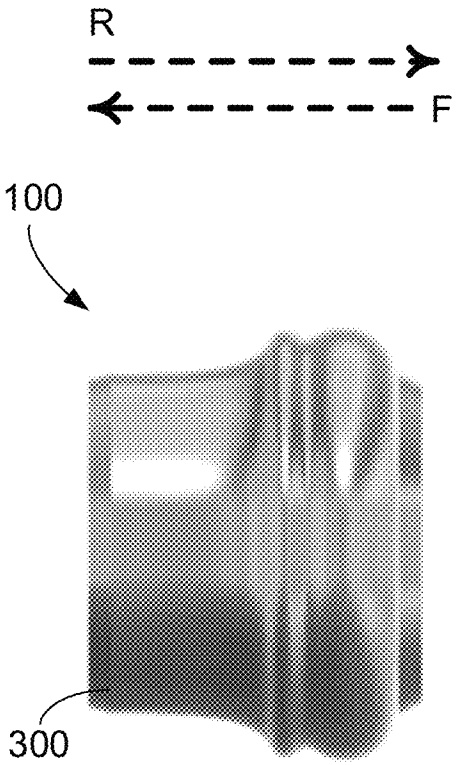
Figure 9A:
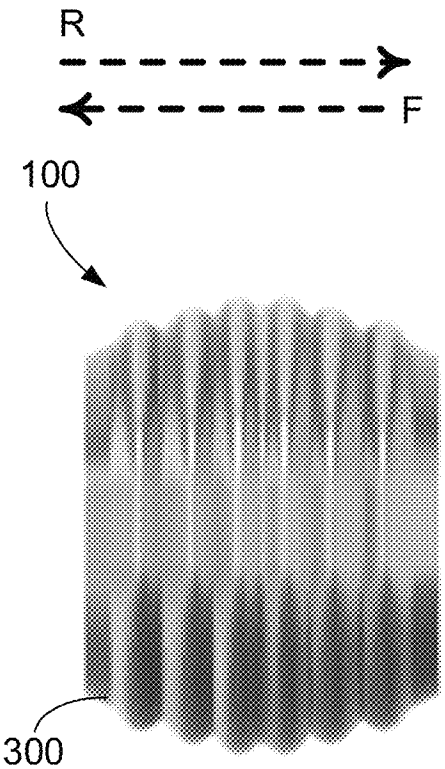
Figure 10C:
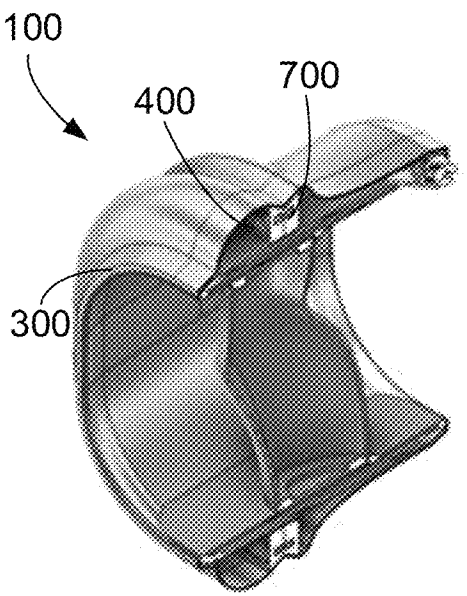
FIGS. 10A-10C are perspective cutaway views of the example of the hand weight of FIG. 1 in the first, second, and third states, respectively.
Figure 10B:
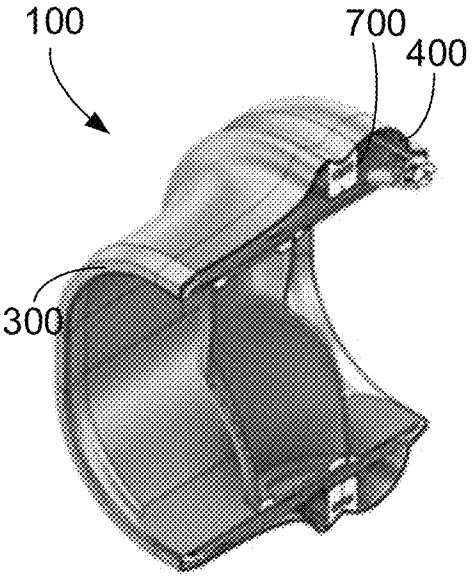
Figure 10A:
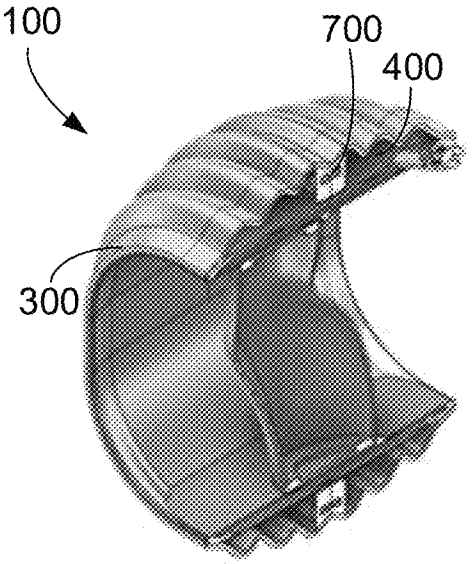
Figure 11C:
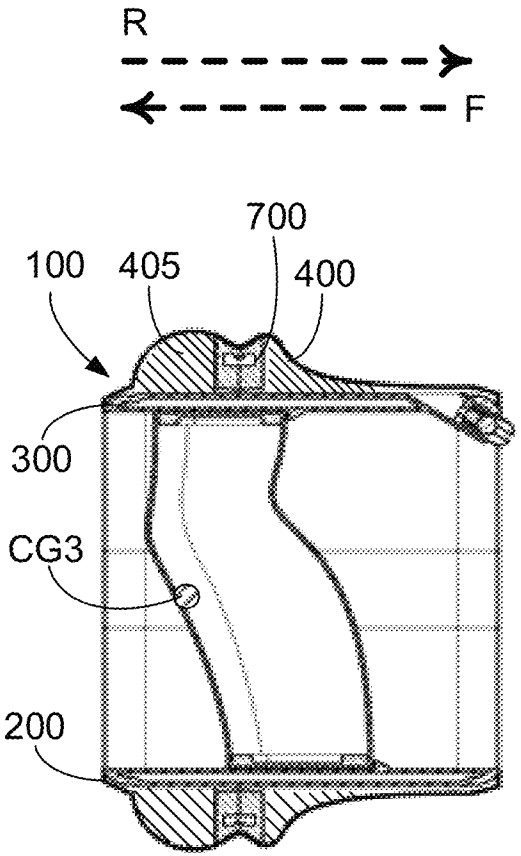
FIGS. 11A-11C are side cutaway views of the example of the hand weight of FIG. 1 in the first, second, and third states, respectively.
Figure 11B:
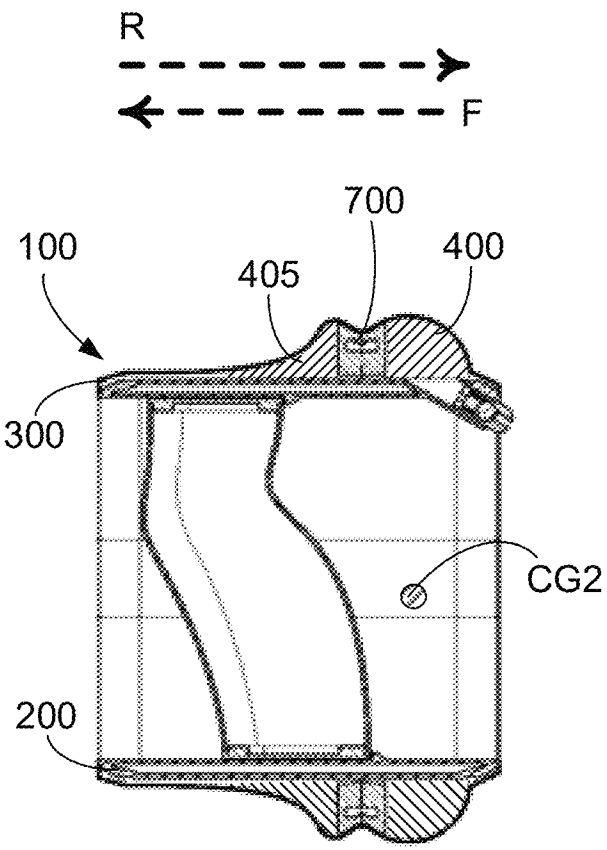
Figure 11A:
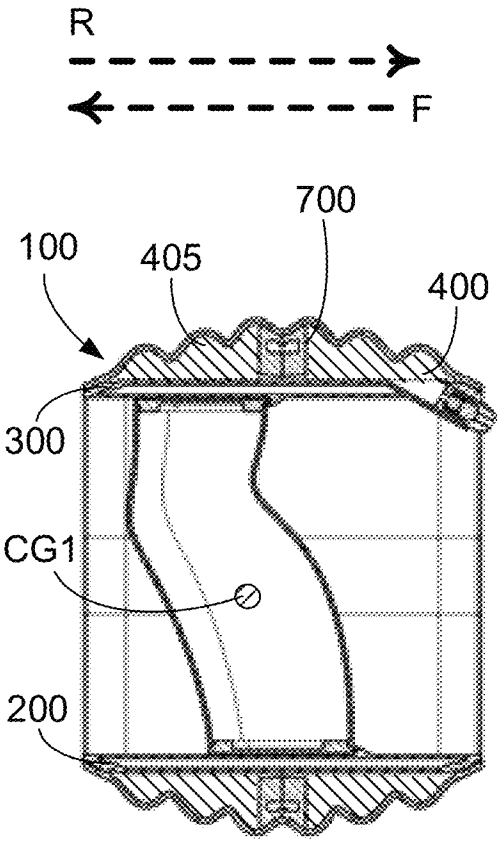
Figure 12A:
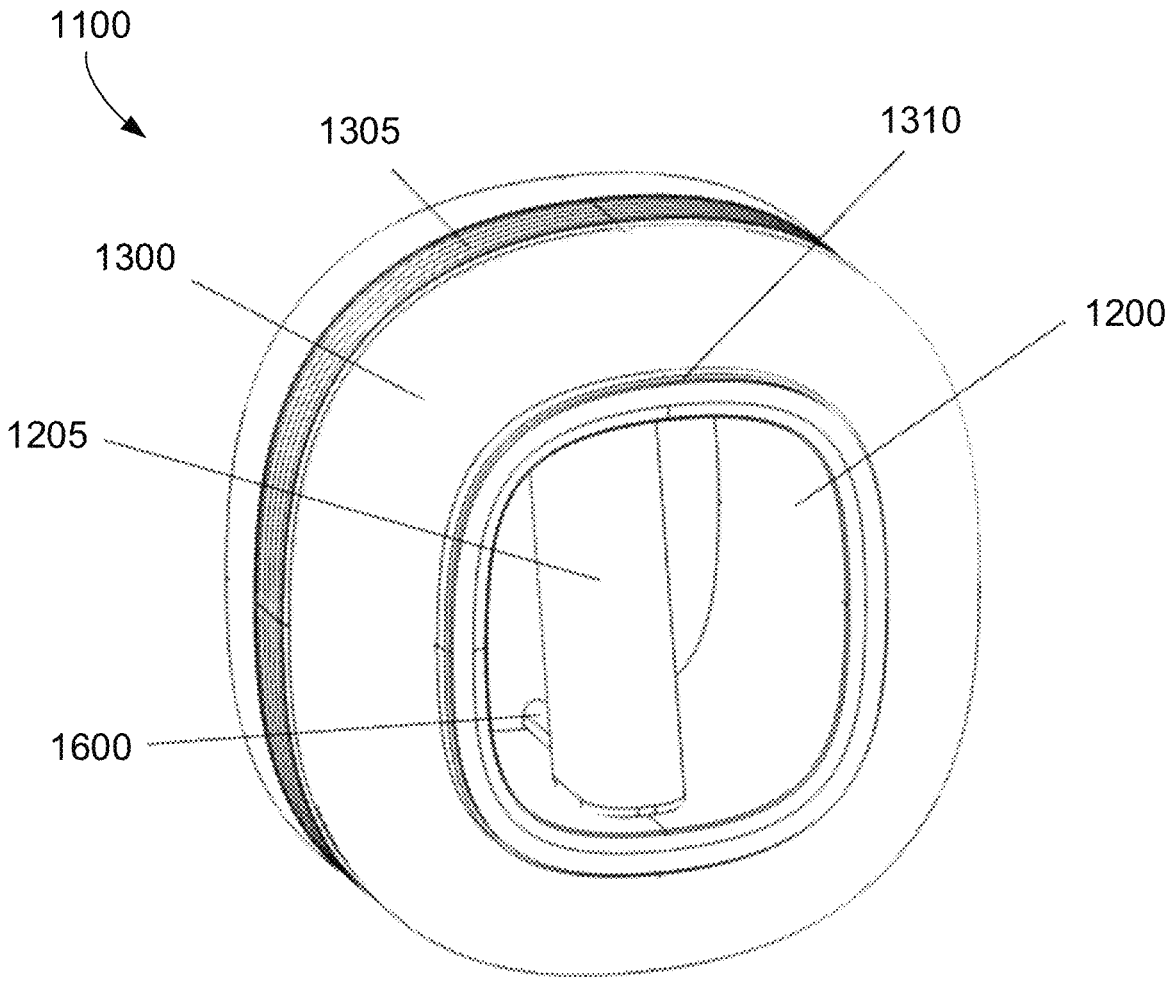
FIGS. 12A-12D are front perspective, side, rear, and perspective cutaway views of another example of a hand weight.
Figure 12B:
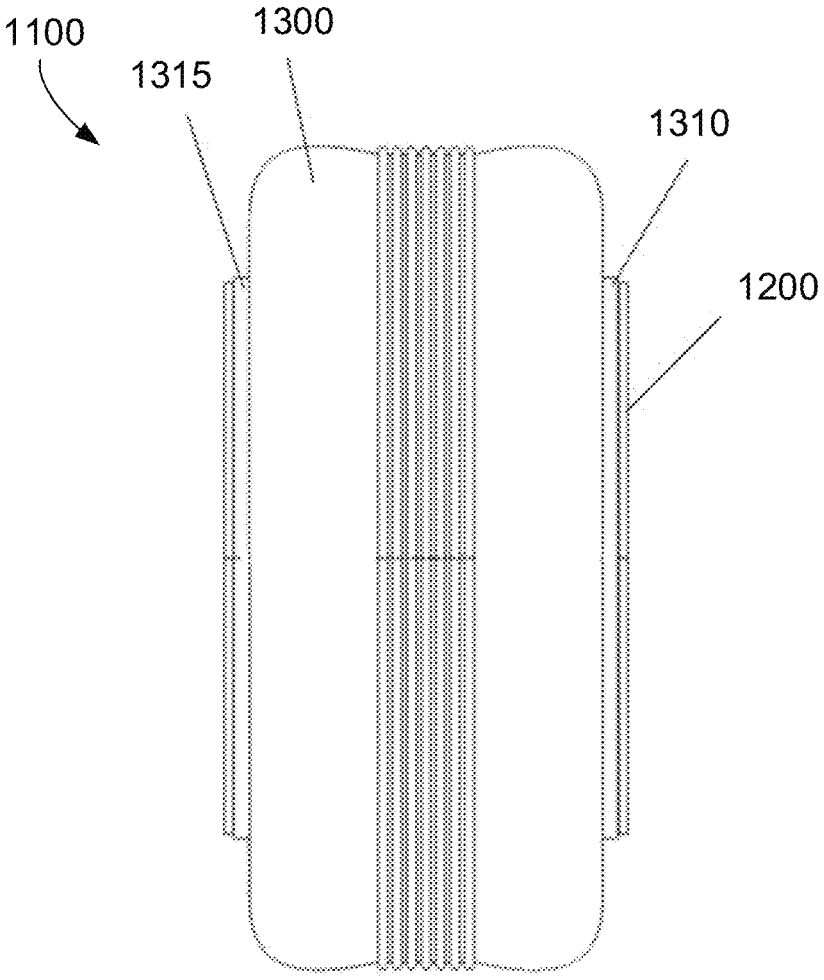
Figure 12C:
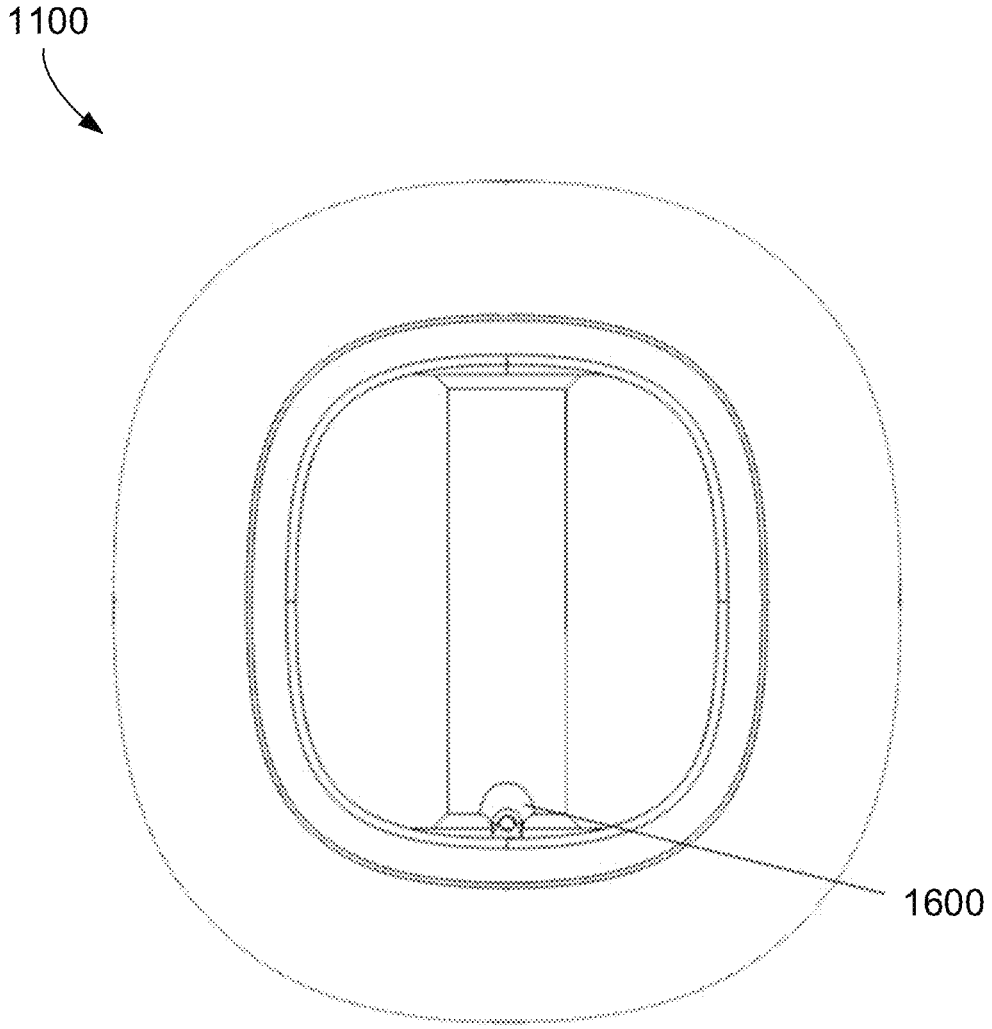
Figure 12D:
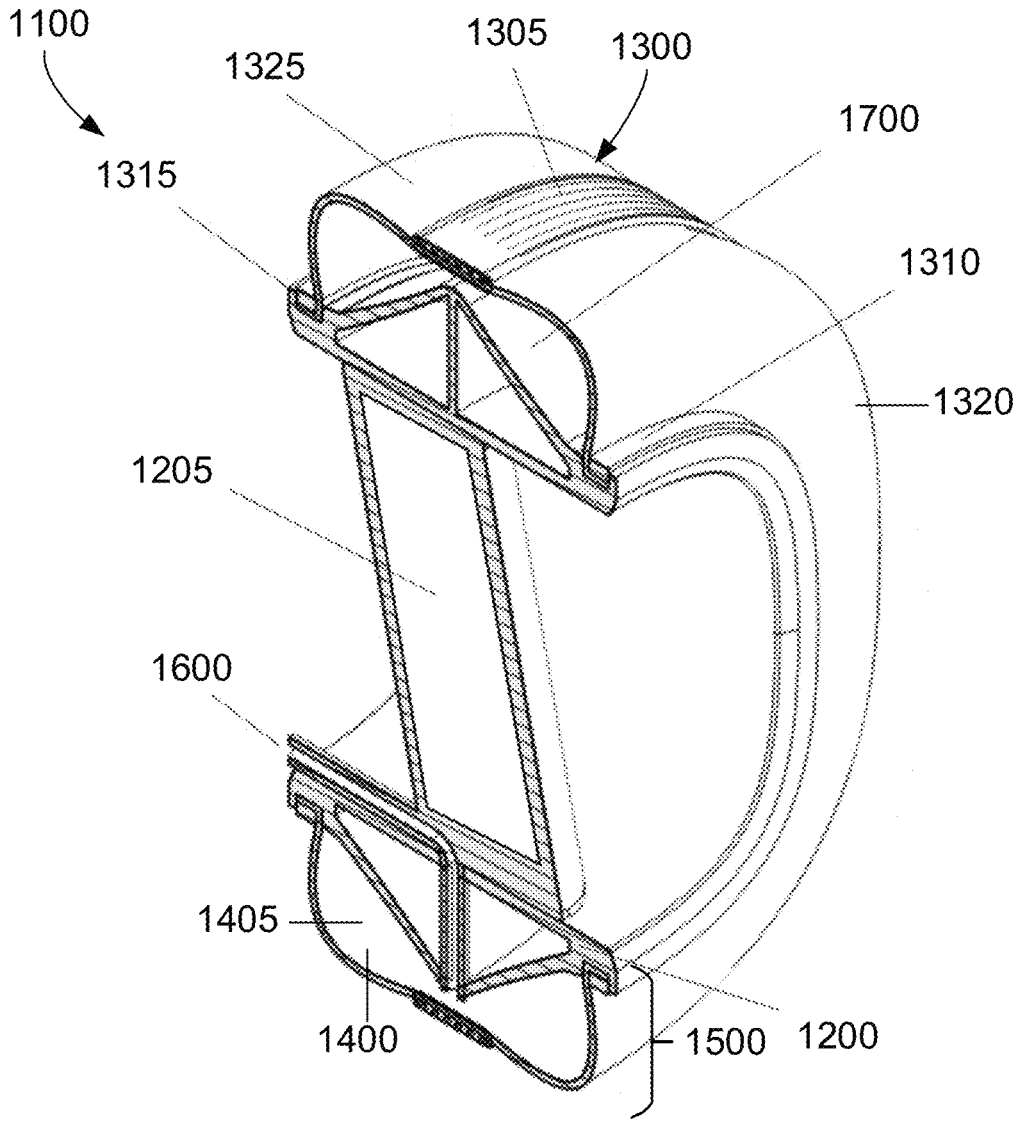

FIGS. 9A-9C, 10A-10C, and 11A-11C illustrate different states of the hand weight 100 during use. FIGS. 9A, 10A, and 11A illustrate the hand weight 100 in a first state. FIGS. 9B, 10B, and 11B illustrate the hand weight 100 in a second state. And FIGS. 9C, 10C, and 11C illustrate the hand weight 100 in a third state. The first, second, and third states are described with respect to a punching motion by a user, although in other implementations, the hand weight 100 can be used for other exercise motions. The punching motion, as described in this disclosure, includes translation along the central axis CA and rotation about the central axis CA of the hand weight 100.

In a method of using the hand weight 100 (e.g., during a punching motion of a hand of the user while using the hand weight 100), a user applies a force and accelerates the hand weight 100 along an axis, e.g., the central axis CA, in a forward direction, e.g., relative to a body of the user, thereby causing the hand weight 100 to transition from the first state (FIGS. 9A, 10A, 11A) to the second state (FIGS. 9B, 10B, 11B). The force applied by the user is directed in the forward direction along the axis. The force is, for example, a pushing force on the hand weight away from the body of the user. The acceleration of the hand weight 100 in the forward direction causes the center of gravity to shift from a location in the first state (i.e., a center of gravity CG1) to a location in the second state (i.e., a center of gravity CG2). In particular, this acceleration causes the center of gravity to shift along the central axis CA in the rearward direction relative to the hand of the user. While applying the pushing force on the hand weight, the user can also apply a torque in a first direction (e.g., a counterclockwise direction) about the axis. The torque and the force can be applied simultaneously, e.g., in a punching motion.

Furthermore, in the method of using the hand weight 100, the user applies a force and accelerates the hand weight 100 along the axis in the rearward direction, e.g., relative to the body of the user, thereby causing the hand weight 100 to transition from the second state (FIGS. 9B, 10B, 11C) to the second state (FIGS. 9C, 10C, 11C). The force applied by the user is directed in the rearward direction along the axis. The force is, for example, a pulling force on the hand weight away from the body of the user. The acceleration of the hand weight 100 in the rearward direction causes the center of gravity to shift from the location in the second state (i.e., a center of gravity CG2) to the location in the third state (i.e., a center of gravity CG3). In particular, this acceleration causes the center of gravity to shift along the central axis CA in the forward direction relative to the hand of the user. While applying the pulling force on the hand weight, the user can also apply a torque in a second direction (e.g., a clockwise direction) about the axis. The torque and the force can be applied simultaneously, e.g., in a punching motion.

In the first state (FIGS. 9A, 10A, and 11A), the baffle 700 is a neutral position along a central portion of the chassis 200. The first state corresponds to a state of the hand weight 100 when an external force by the user is not applied. For example, the user is grasping the hand weight 100 and has not initiated a punching motion. The first portion 410 and the second portion 415 (shown in FIG. 2H) of the cavity 400 can be equally sized, and the movable mass 405 (shown in FIG. 2H) can be equally distributed between the first portion 410 and the second portion 415 of the cavity 400. The flexible element 300 is similarly in a neutral position, with its spaced-apart raised portions 305 being present and being spaced apart. In the first state, the center of gravity CG1 of the hand weight 100 is positioned on the hand or forearm of the user. The center of gravity CG1 can be, for example, positioned over the wrist of the user.

The second state (FIGS. 9B, 10B, and 11B) corresponds to a state of the hand weight 100 after the user initiates the punching motion and the user is applying a forward force on the hand weight 100. The forward acceleration applied by the user (e.g., due to translational force applied by the user) causes the hand weight 100 to move in a forward direction F parallel to the central axis CA. A rotational acceleration applied by the user (e.g., due to a torque applied by the user) causes the hand weight 100 to rotate about the central axis CA.

In response to the force applied by the user in the forward direction F, the baffle 700 and the movable mass 405 travel in a rearward direction R relative to the chassis 200 due to inertia of the movable mass 405. In particular, the sprung mass 810 (shown in FIG. 2H) has sufficient inertia such that the baffle 700, the movable mass 405, and at least a portion of the flexible element 300 lag behind the rest of the hand weight 100 as the hand weight 100 is accelerated in the forward direction F. For example, the baffle 700 and the movable mass 405 are shifted rearwardly relative to the chassis 200 at least the portion of the flexible element 300 is deformed rearwardly relative to the chassis 200 in response to the force applied by the user.

In response to the torque applied by the user, the movable mass 405 can rotate about the central axis CA in a first direction within the cavity 400. In the second state, in a reference frame of the hand weight 100, the center of gravity CG2 of the hand weight 100 is offset rearwardly relative to the center of gravity CG1. In particular, in a reference frame of the user, the center of gravity CG2 is positioned further up the arm of the user, e.g., along the forearm of the user. The center of gravity CG2 can be, for example, positioned away from the wrist of the user in the rearward direction F.

The second state can further represent a period toward the end of the punching motion when the user is slowing the hand weight 100 to a stop by applying a force in the forward direction F. In this portion of the punching motion, the torque is applied in a direction opposite the direction described above, thus causing the movable mass 405 to rotate in a second direction about the central axis CA.

The third state (FIGS. 9C, 10C, and 11C) corresponds to a state of the hand weight 100 as the user applies a rearward force on the hand weight 100. During this portion of the punching motion, the user applies a force in the rearward direction R and applies a torque on the hand weight 100 in the same direction as the torque applied to move the hand weight 100 from the first state to the second state.

In response to the force applied by the user in the rearward direction R, the baffle 700 and the movable mass 405 travel in a forward direction F relative to the chassis 200 due to inertia of the movable mass 405. In particular, the sprung mass 810 (shown in FIG. 2H) has sufficient inertia such that the baffle 700 and the movable mass 405, and at least a portion of the flexible element 300 lag behind the hand weight 100 (e.g., in the forward direction F) as the hand weight 100 is accelerated in the rearward direction R. For example, the baffle 700 and the movable mass 405 are shifted forwardly relative to the chassis 200 at least the portion of the flexible element 300 is deformed forwardly relative to the chassis 200 in response to the force applied by the user.

In response to the torque applied by the user, the movable mass 405 can rotate about the central axis CA in the first direction within the cavity 400 (e.g., during the period of the forward motion in which the user is slowing the forward motion of the hand weight 100) and then rotate about the second direction within the cavity 400 (e.g., during the period of the rearward motion in which the user is pulling the hand weight 100 back toward the body). In the second state, in a reference frame of the hand weight 100, the center of gravity CG3 of the hand weight 100 is offset forwardly relative to the center of gravity CG1. In particular, in a reference frame of the user, the center of gravity CG3 can be positioned over the hand or slightly forward of the hand. The center of gravity CG3 can be, for example, positioned away from the wrist of the user in the forward direction F.

Further Alternative Implementations

A number of implementations have been described. While this specification contains many specific implementation details, these should not be construed as limitations on the scope of what is being claimed, which is defined by the claims themselves, but rather as descriptions of features that may be specific to particular implementations of particular inventions. It will be understood that various modifications may be made.

Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially be claimed as such, one or more features from a claimed combination can in some cases be excised from the combination, and the claim may be directed to a subcombination or variation of a subcombination.

The toroidal structure 500, including the outer surface of the toroidal structure 500 and the cavity 400 defined within the toroidal structure 500, can vary in implementations.

The cavity 400 can include two or more discontinuous sections separating a first portion of the movable mass 405 from a second portion of the movable mass 405. For example, the cavity 400 can include a first section spanning about 180 degrees about the central axis CA and a second section spanning a separate 180 degrees about the central axis CA. The first section can accommodate the first portion of the movable mass 405, and the second section can accommodate the second portion of the movable mass 405. The first section and the second section can be separated by walls or dividers preventing the first portion of the movable mass 405 from rotating into the second section and preventing the second portion of the movable mass 405 from rotating into the first section. In other implementations, the cavity 400 spans less than 360 degrees around the central axis CA. In such implementations, the movable mass 405 is movable within the cavity 400 but is unable to move continuously around a loop formed by the cavity 400.

While the opening 505 (shown in FIGS. 2A-2H) is described as extending through the entirety of the hand weight 100 along the central axis CA, in some implementations, the opening 505 extends through only a portion of the hand weight 100 along the central axis CA. In such implementations, the hand weight 100 is accessible from only one end of the opening 505.

Furthermore, the tube 510 forming the toroidal structure 500 is described as having a non-circular cross-section. In implementations, the tube 510 has a circular, elliptical, polygonal, non-polygonal, or other shaped cross section.

Dimensions of the hand weight can vary in implementations. A maximum dimension of the hand weight is no more than 25 centimeters, e.g., no more than 20 centimeters, no more than 15 centimeters, between 10 and 25 centimeters, between 12 and 20 centimeters, etc.

An overall mass quantity of the hand weight 100 can vary in implementations depending on the exercise that the hand weight 100 is to be used for. In some implementations, the hand weight 100 has a mass quantity appropriate for a punching exercise. For example, the hand weight 100 can have a mass quantity of no more than 5 kilograms, e.g., no more than 4 kilograms, no more than 3 kilograms, no more than 2 kilograms, no more than 1.5 kilograms, no more than 1 kilogram, no more than 0.5 kilograms, between 0.5 and 5 kilograms, between 0.5 and 4 kilograms, between 0.5 and 3 kilograms, between 0.5 and 2 kilograms, or between 0.5 and 1 kilograms. The movable mass 400 has a mass quantity forming a percentage of the overall mass quantity of the hand weight 100. In some implementations, the mass quantity of the movable mass is no less than 10% of the overall mass quantity of the hand weight 100, e.g., no less than 20%, no less than 30%, no less than 40%, or no less than 50% of the overall mass quantity of the hand weight 100.

The flexible element 300 is described as a flexible membrane. In implementations, the hand weight 100 can include one or more flexible elements that deform in response to movement of the movable mass 405 within the cavity 400. For example, the one or more flexible elements can include a first flexible element that defines a first cavity within which a first portion of the movable mass 405 is positioned and a second flexible element that defines a second cavity within which a second portion of the movable mass 405 is positioned. In such implementations, the first and second cavities could have features similar to those described with respect to the cavity 400. For example, one, both, or neither of the first cavity and the second cavity can form a loop around which a portion of the movable mass is movable. The first and second cavities can be arranged around an entirety of or a part of the chassis 200. In some implementations, the first and second cavities are arranged on opposite halves of the chassis 200, with the first cavity being arranged on one side of a plane extending along the central axis CA and the second cavity being arranged on the other side of the plane. In other implementations, this plane is transverse to the central axis CA. In further implementations, the one or more flexible elements can include three or more flexible elements, each with corresponding portions of the movable mass 405 and each at least partially defining corresponding cavities.

The handle portion 205 is described as extending across the opening 505 along an axis that is perpendicular to the central axis CA and as being attached to the chassis 200 at two opposing points. In other implementations, the handle portion 205 is only attached at one point along the chassis 200, while in other implementations, the handle portion 205 is attached at three or more points along the chassis 200.

FIGS. 12A-14C illustrate another example of a hand weight 1100. Referring to FIGS. 12A-12D The hand weight 1100 includes a chassis 1200, a handle portion 1205 of the chassis 1200, a flexible element 1300, a cavity 1400 at least partially defined by the chassis 1200 and the flexible element 1300, a movable mass 1405 within the cavity 1400, a toroidal structure 1500 at least partially defined by the chassis 1200 and the flexible element 1300, a sealable opening 1600, and a baffle 1700.

The handle portion 1205, the cavity 1400, the movable mass 1405, the toroidal structure 1500, and the sealable opening 1600 are similar to the handle portion 205, the cavity 400, the movable mass 405, the toroidal structure 500, and the sealable opening 600, respectively, described with respect to FIGS. 1-11C. Any features described with respect to the handle portion 205, the cavity 400, the movable mass 405, the toroidal structure 500, and the sealable opening 600 in this disclosure are thus encompassed within implementations of the hand weight 1100.

The hand weight 1100 differs from the hand weight 100 in the structure of the flexible element 1300, the chassis 1200, and the baffle 1700. With respect to the flexible element 1300, the flexible element 1300 differs from the flexible element 300 in the way that the flexible element 1300 is attached to the chassis 1200 and in the way that the flexible element 1300 extends from one end of the chassis 1200 to the other end of the chassis 1200. The flexible element 1300 includes rigid bands 1305, 1310, and 1315, a first flexible portion 1320 between the rigid band 1305 and the rigid band 1310, and a second flexible portion 1325 between the rigid band 1310 and the rigid band 1315. The first flexible portion 1320 is attached to the chassis 1200 using the rigid band 1310 and is attached to the second flexible portion 1325 using the rigid band 1305. The second flexible portion 1325 is attached to the chassis 1200 using the rigid band 1315 and is attached to the first flexible portion 1320 using the rigid band 1305. The rigid bands 1305, 1310, 1315 are ring-shaped structures extending along an entire perimeter of the flexible element 1300.

With respect to the chassis 1200 and the baffle 1700, the baffle 1700 differs from the baffle 700 in that the baffle 1700 is not slidably mounted relative to the chassis 1200. Rather, the baffle 1700 is fixed to the chassis 1200. In the example shown in FIG. 12D, the baffle 1700 is integral to the chassis 1200, and the chassis 1200 includes the baffle 1700. For example, the baffle 1700 is part of the same material forming the chassis 1200. The baffle 1700 corresponds to a radially outwardly protruding portion of the chassis 1200 that at least partially defines the cavity 400. As shown in FIGS. 13A-13C and 14A-14C, the baffle 1700 does not move relative to the chassis 1200 during use of the hand weight 1100.

Figure 13C:
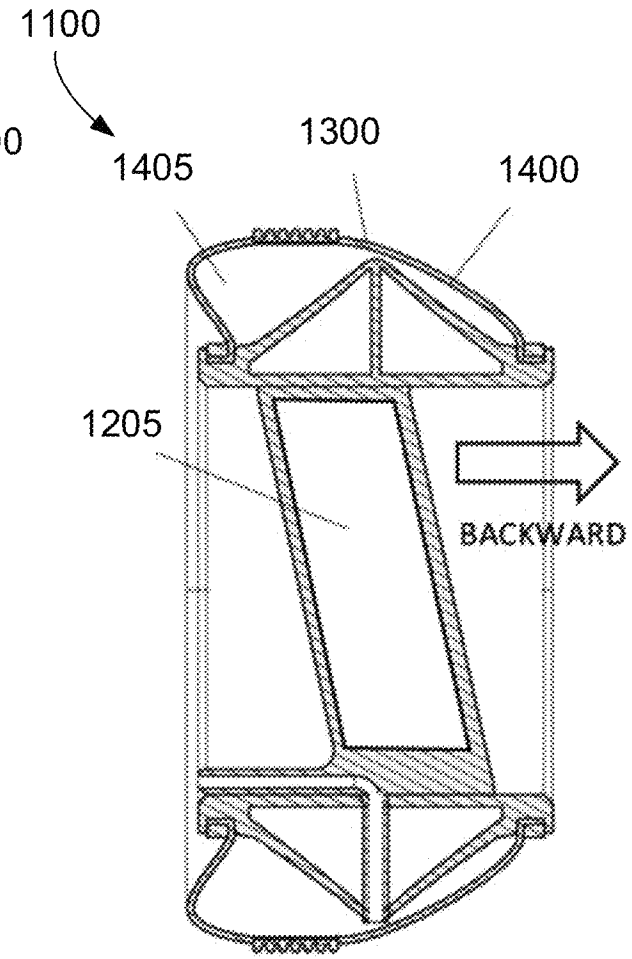
FIGS. 13A-13C are side cutaway views of the example of the hand weight of FIGS. 12A-12D in first, second, and third states, respectively
Figure 13B:
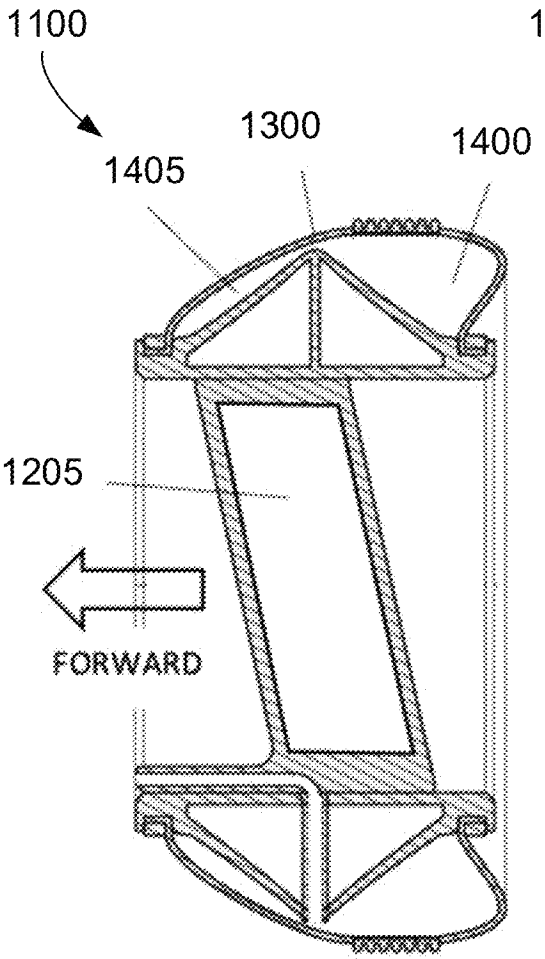
Figure 13A:
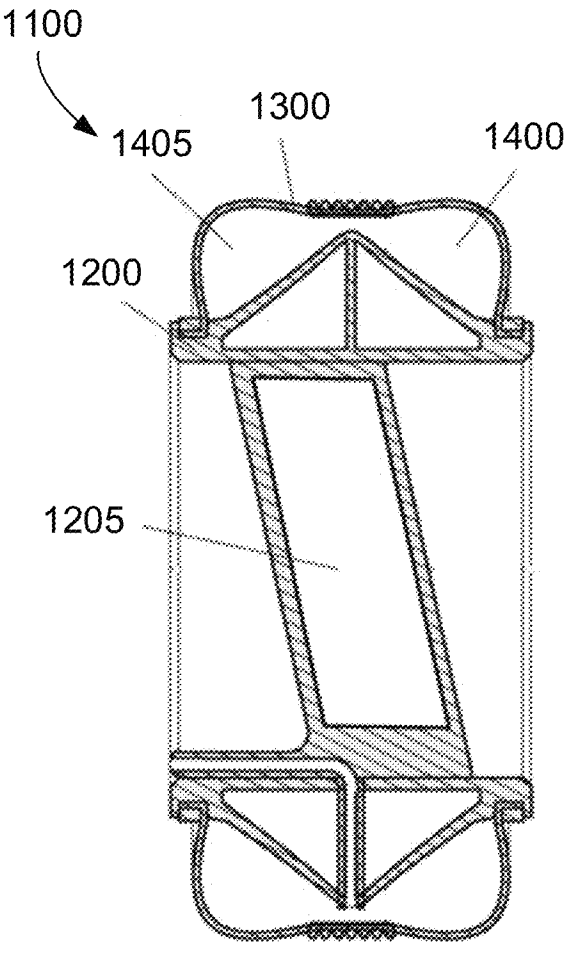
Figure 14A:
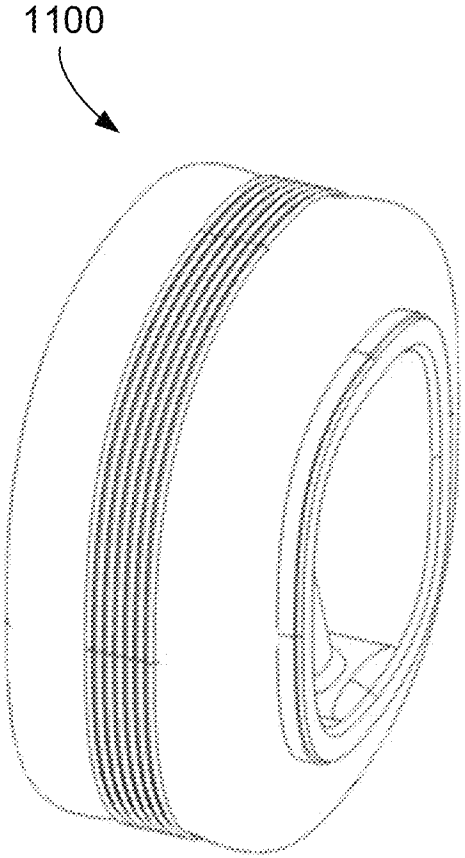
FIGS. 14A-14C are perspective views of the example of the hand weight of FIGS. 12A-12D in first, second, and third states, respectively Like reference numbers and designations in the various drawings indicate like elements.
Figure 14B:
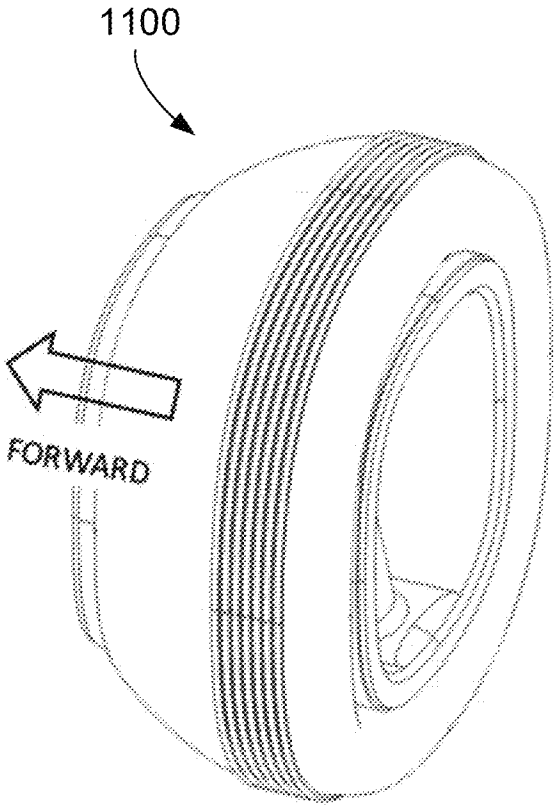
Figure 14C:
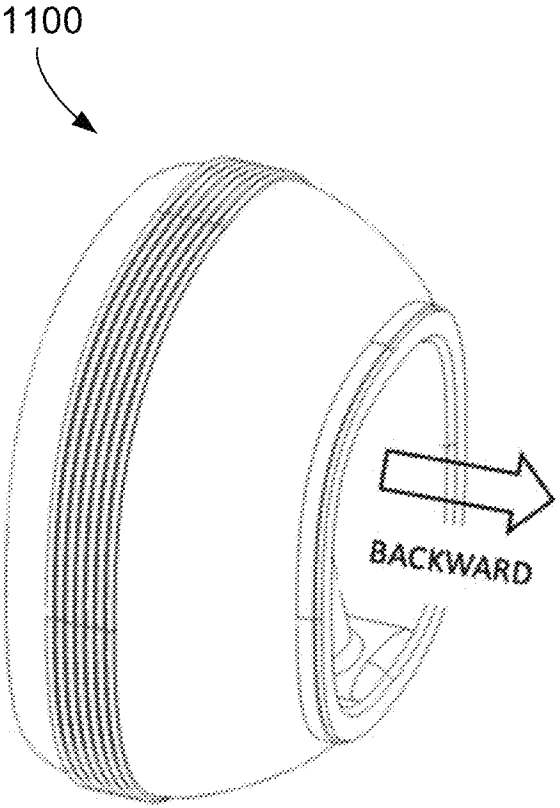

The use of the hand weight 1100 is similar to the use of the hand weight 100 with the exception that the baffle 1700 does not move as the hand weight 1100 is moved between the first state (FIGS. 13A, 14A) and the second state (FIGS. 13B, 14B) or as the hand weight 1100 is moved between the second state (FIGS. 13B, 14B) and the third state (FIGS. 13C, 14C). Thus the baffle 1700 does not form part of a sprung mass of the hand weight 1100 in implementations represented by the examples of FIGS. 12A-14C. Nevertheless, the baffle 1700 serves to restrict free flow of the movable mass 1405 to further smooth out the force experienced by the user when using the hand weight 1100.

Accordingly, other implementations are within the scope of the claims.

What is claimed is:

1. A hand weight comprising:

a body;

a handle attached to the body and positioned in an opening of the body, the handle configured to be grasped by a user;

one or more flexible membranes positioned around the body, the one or more flexible membranes being attached to the body; and one or more cavities positioned around the body and being at least partially defined by the one or more flexible membranes and the body, wherein the one or more cavities are configured to collectively receive a movable mass that is movable within the one or more cavities, the movable mass configured to move relative to the body and cause deformation of the one or more flexible membranes in response to a force applied to the handle by the user while grasping the handle.

2. The hand weight of claim 1, wherein:

the one or more flexible membranes comprises a plurality of flexible membranes; and the one or more cavities comprises a plurality of cavities being at least partially defined by the plurality of flexible membranes, respectively, and the body.

3. The hand weight of claim 2, wherein:

the plurality of flexible membranes form a loop around the body.

4. The hand weight of claim 2, wherein:

each of the plurality of flexible membranes form a loop around the body.

5. The hand weight of claim 2, wherein:

only one of the plurality of flexible membranes forms a loop around the body.

6. The hand weight of claim 2, wherein:

the plurality of flexible membranes comprise a first flexible membrane and a second flexible membrane;

the plurality of cavities comprise:

a first cavity at least partially defined by the first flexible membrane and configured to receive a first portion of the movable mass; and a second cavity at least partially defined by the second flexible membrane and configured to receive a second portion of the movable mass.

7. The hand weight of claim 6, wherein:

at least one of the first cavity or the second cavity form a loop around which a portion of the movable mass is movable.

8. The hand weight of claim 6, wherein:

the first cavity is arranged on a first half of the body, and the second cavity is arranged on a second half of the body.

9. The hand weight of claim 1, wherein:

the body comprises an outer surface to which the one or more flexible membranes are attached.

10. The hand weight of claim 1, wherein:

the handle comprises a body portion asymmetric relative to a central axis of the hand weight, the body portion comprising a convex portion for supporting a contour of a palm of the user and a concave portion for supporting tissue between a thumb and fingers of the user when the user is grasping the handle.

11. The hand weight of claim 1, wherein:

the one or more flexible membranes are attached to an outer surface of the body along a perimeter of a first end portion of the body and along a perimeter of a second end portion of the body.

12. The hand weight of claim 1, wherein:

the one or more cavities comprises a cavity comprising a plurality of discontinuous sections configured to separate a first portion of the movable mass from a second portion of the movable mass.

13. The hand weight of claim 12, comprising:

a wall dividing a first section of the plurality of discontinuous sections from a second section of the plurality of discontinuous sections, the wall configured to prevent the first portion of the movable mass from moving from the first section to the second section and to prevent the second portion of the movable mass from moving from the second section to the first section.

14. The hand weight of claim 1, wherein:

the body is a ring-shaped structure defining the opening within which the handle is positioned, the ring-shaped structure arranged around a central axis of the hand weight.

15. The hand weight of claim 14, wherein:

the handle extends along an axis perpendicular to the central axis of the hand weight.

16. A method of using a hand weight graspable by a hand of a user, the method comprising:

grasping the hand weight at a handle positioned in an opening extending through a central axis of the hand weight, the opening defined by a body of the hand weight;

applying a force in a first direction along an axis, wherein applying the force in the first direction comprises causing a movable mass to move in a second direction along the axis to deform one or more flexible membranes positioned around the central axis of the hand weight to deform in a second direction along the axis relative to the hand of the user and to shift a center of gravity of the hand weight along the axis in the second direction along the axis relative to the hand of the user; and applying a torque in a first direction about the axis, wherein applying the torque on the hand weight in the first direction about the axis comprises causing rotation of the movable mass relative to the body of the hand weight in a second direction about the axis.

17. The method of claim 16, wherein:

the axis corresponds to the central axis of the hand weight.

18. The method of claim 17, wherein:

the first direction along the axis corresponds to a forward direction along the central axis of the hand weight, and the second direction along the axis corresponds to a rearward direction along the central axis of the hand weight.

19. The method of claim 16, wherein:

applying the force in the first direction along the axis comprises:

applying a pushing force at a location within the opening extending through the central axis of the hand weight.

20. The method of claim 16, wherein:

applying the force in the first direction along the axis comprises applying the force in the first direction along the axis during a punching motion; and applying the torque in the first direction about the axis comprises applying the torque in the first direction about the axis during the punching motion.

* * * * *